US012338099B2

(12) United States Patent
Matsumoto

(10) Patent No.: US 12,338,099 B2
(45) Date of Patent: Jun. 24, 2025

(54) SHEET FEEDING DEVICE AND IMAGE FORMING APPARATUS

(71) Applicant: CANON KABUSHIKI KAISHA, Tokyo (JP)

(72) Inventor: So Matsumoto, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 248 days.

(21) Appl. No.: 17/347,729

(22) Filed: Jun. 15, 2021

(65) Prior Publication Data

US 2022/0002104 A1 Jan. 6, 2022

(30) Foreign Application Priority Data

Jul. 3, 2020 (JP) ..... 2020-115861

(51) Int. Cl.
*B65H 9/16* (2006.01)
*B65H 7/10* (2006.01)
*B65H 9/10* (2006.01)

(52) U.S. Cl.
CPC ..... *B65H 9/166* (2013.01); *B65H 7/10* (2013.01); *B65H 9/103* (2013.01); *B65H 2404/1424* (2013.01); *B65H 2404/742* (2013.01)

(58) Field of Classification Search
CPC ..... B65H 9/166; B65H 2404/1424; B65H 2404/1441; B65H 2404/741; B65H 2404/742
See application file for complete search history.

(56) References Cited

U.S. PATENT DOCUMENTS 6,273,418 B1 8/2001 Fujikura et al.
8,011,649 B2 * 9/2011 Yahata ..... B65H 35/0006 270/58.07
8,020,858 B2 * 9/2011 deJong ..... B65H 9/002 271/227
8,292,293 B2 * 10/2012 Inoue ..... B65H 9/002 271/227
8,342,518 B2 1/2013 Matsumoto
8,382,104 B2 2/2013 Yasumoto
8,585,047 B2 11/2013 Sato
8,695,973 B2 * 4/2014 deJong ..... B65H 9/002 271/228

(Continued)

FOREIGN PATENT DOCUMENTS

CN 102233749 A 11/2011
JP S63-171750 A 7/1988

(Continued)

OTHER PUBLICATIONS

Nov. 30, 2021 European Search Report in European Patent AppIn. No. 21180761.5.

(Continued)

*Primary Examiner* — Patrick Cicchino
(74) *Attorney, Agent, or Firm* — Venable LLP

(57) ABSTRACT

A sheet feeding device includes a first feeding roller pair, a reference member, an obliquely feeding roller, a second feeding roller pair, a detecting portion, and a controller. Before a sheet is obliquely fed by the obliquely feeding roller, the controller causes the first feeding roller to move the sheet to a predetermined position in a widthwise direction of the sheet on the basis of a detection result of the detecting means.

16 Claims, 24 Drawing Sheets

(56) References Cited

U.S. PATENT DOCUMENTS

| | | | | |
|---|---|---|---|---|
| 8,888,093 | B2 | 11/2014 | Ino | |
| 9,026,029 | B2 * | 5/2015 | Furuyama | G03G 15/6561 399/388 |
| 9,206,005 | B2 | 12/2015 | Fujita et al. | |
| 9,550,643 | B2 | 1/2017 | Matsumoto et al. | |
| 9,738,474 | B2 * | 8/2017 | Koizumi | B65H 9/20 |
| 10,160,237 | B2 * | 12/2018 | Herrmann | B65H 9/16 |
| 10,343,862 | B2 | 7/2019 | Matsumoto et al. | |
| 10,618,760 | B2 * | 4/2020 | Ishioka | B65H 9/166 |
| 10,747,161 | B2 | 8/2020 | Nakamura et al. | |
| 10,852,683 | B2 | 12/2020 | Matsumoto | |
| 11,180,334 | B2 * | 11/2021 | Matsumoto | B65H 5/062 |
| 2010/0283199 | A1 | 11/2010 | Yasumoto | |
| 2011/0266742 | A1 | 11/2011 | Sato | |
| 2014/0193186 | A1 | 7/2014 | Furuyama | |
| 2015/0284204 | A1 | 10/2015 | Matsumoto | |
| 2016/0280487 | A1 | 9/2016 | Koizumi | |
| 2017/0088375 | A1 | 3/2017 | Matsumoto | |
| 2018/0117934 | A1 * | 5/2018 | Herrmann | B41J 13/26 |
| 2019/0023511 | A1 | 1/2019 | Ishioka et al. | |
| 2019/0025749 | A1 | 1/2019 | Iwasaki et al. | |
| 2019/0025750 | A1 | 1/2019 | Matsumoto | |
| 2022/0002104 | A1 * | 1/2022 | Matsumoto | B65H 7/10 |

FOREIGN PATENT DOCUMENTS

| | | | |
|---|---|---|---|
| JP | H11-189355 | A | 7/1999 |
| JP | 2004-059188 | A | 2/2004 |
| JP | 2010-260696 | A | 11/2010 |
| JP | 2015-199551 | A | 11/2015 |
| JP | 2019-023135 | A | 2/2019 |

OTHER PUBLICATIONS

Aug. 1, 2023 Chinese Official Action in Chinese Patent Appln. No. 202110747253.5.

Zhang Zhongfu, Zhong Jiangsheng, et al., Electromechanical Transmission and Control, Mechanical Industry Press, Aug. 31, 2001, pp. 387-388.

Mar. 22, 2024 Chinese Official Action in Chinese Application No. 202110747253.5.

May 21, 2024 Japanese Official Action in Japanese Patent Appln. No. 2020-115861.

Oct. 7, 2024 Korean Official Action in Korean Patent Appln. No. 10-2021-0086874.

* cited by examiner (a)

(b)

SHEET FEEDING DEVICE AND IMAGE FORMING APPARATUS

FIELD OF THE INVENTION AND RELATED ART

The present invention relates to a sheet feeding device for feeding a sheet and an image forming apparatus including the sheet feeding device.

Conventionally, an image forming apparatus capable of correcting a positional deviation of the sheet in a widthwise direction of the sheet perpendicular to a sheet feeding direction and oblique movement of the sheet while feeding the sheet has been used.

For example, in Japanese Laid-Open Patent Application (JP-A) Hei 11-189355, a sheet feeding device of a so-called side registration type in which the sheet is fed toward a reference member by an obliquely feeding roller while laterally shifting the sheet and is abutted at a side end thereof against the reference member and in which oblique movement is this corrected and then the sheet is fed to a downstream roller pair has been disclosed.

However, in the side registration type, in a state in which the side end of the sheet is abutted against the reference member, the sheet is fed along the reference member to the downstream roller pair while the obliquely feeding roller is slipped on the sheet.

In this case, a timing until the sheet reaches the downstream roller pair changes depending on a position of the sheet with respect to a feeding direction when a side end portion of the sheet starts to abut against the reference member.

For example, in the case where the side end portion of the sheet starts to abut against the reference member on an upstream side of the reference member, a feeding distance in which the sheet is fed while the side end of the sheet abuts against the reference member is long. That is, a distance in which the obliquely feeding roller feeds the sheet while slipping on the sheet becomes long. Therefore, it takes some time until the sheet reaches the downstream roller pair, so that a timing when the sheet reaches the downstream roller pair becomes late. On the other hand, in the case where the side end portion of the sheet starts to abut against the reference member on a downstream side of the reference member, the feeding distance in which the sheet is fed while the side end of the sheet abuts against the reference member is short. Therefore, the time until the sheet reaches the downstream roller pair is also short, so that the timing when the sheet reaches the downstream roller pair becomes early.

Here, the position of the sheet with respect to the feeding direction when the side end portion of the sheet starts to abut against the reference member depends on a distance between the side end of the sheet and the reference member with respect to a widthwise direction when the obliquely feeding roller starts oblique feeding of the sheet. As a result of this, when a variation in position of the side end of the sheet with respect to the widthwise direction before the obliquely feeding roller obliquely feeds the sheet is large, a variation in position of the sheet with respect to the feeding direction when a leading end of the sheet reaches the downstream roller pair becomes large. Therefore, in the conventional constitution, there is a need to increase an interval between a current sheet and a subsequent sheet while taking the variation in position of the sheet with respect to the sheet feeding direction into consideration, so that productivity of the sheet feeding device (image forming apparatus) is not high.

SUMMARY OF THE INVENTION

A principal object of the present invention is to improve productivity of a sheet feeding device (image forming apparatus) when oblique movement correction of a side registration type is made.

According to an aspect of the present invention, there is provided a sheet feeding device comprising: a first feeding roller pair movable in a widthwise direction of a sheet perpendicular to a sheet feeding direction in a state in which the sheet is nipped and configured to feed the sheet; a reference member provided downstream of the first feeding roller pair with respect to the sheet feeding direction and extending in the sheet feeding direction, the reference member including a contact surface to which an end portion of the sheet with respect to the widthwise direction of the sheet is contactable; an obliquely feeding roller configured to obliquely feed the sheet in an inclination direction relative to the sheet feeding direction so that the sheet approaches the contact surface in the widthwise direction of the sheet with movement of the sheet toward a downstream side of the sheet feeding direction; a second feeding roller pair configured to feed the sheet fed by the obliquely feeding roller; detecting means provided upstream of the first feeding roller pair with respect to the sheet feeding direction and configured to detect a position of the end portion of the sheet with respect to the widthwise direction of the sheet; and a controller configured to control of movement of the first feeding roller pair in the widthwise direction of the sheet; wherein before the sheet is obliquely fed by the obliquely feeding roller, the controller causes the first feeding roller to move the sheet to a predetermined position in the widthwise direction of the sheet on the basis of a detection result of the detecting means.

Further features of the present invention will become apparent from the following description of exemplary embodiments with reference to the attached drawings.

Figure 5:
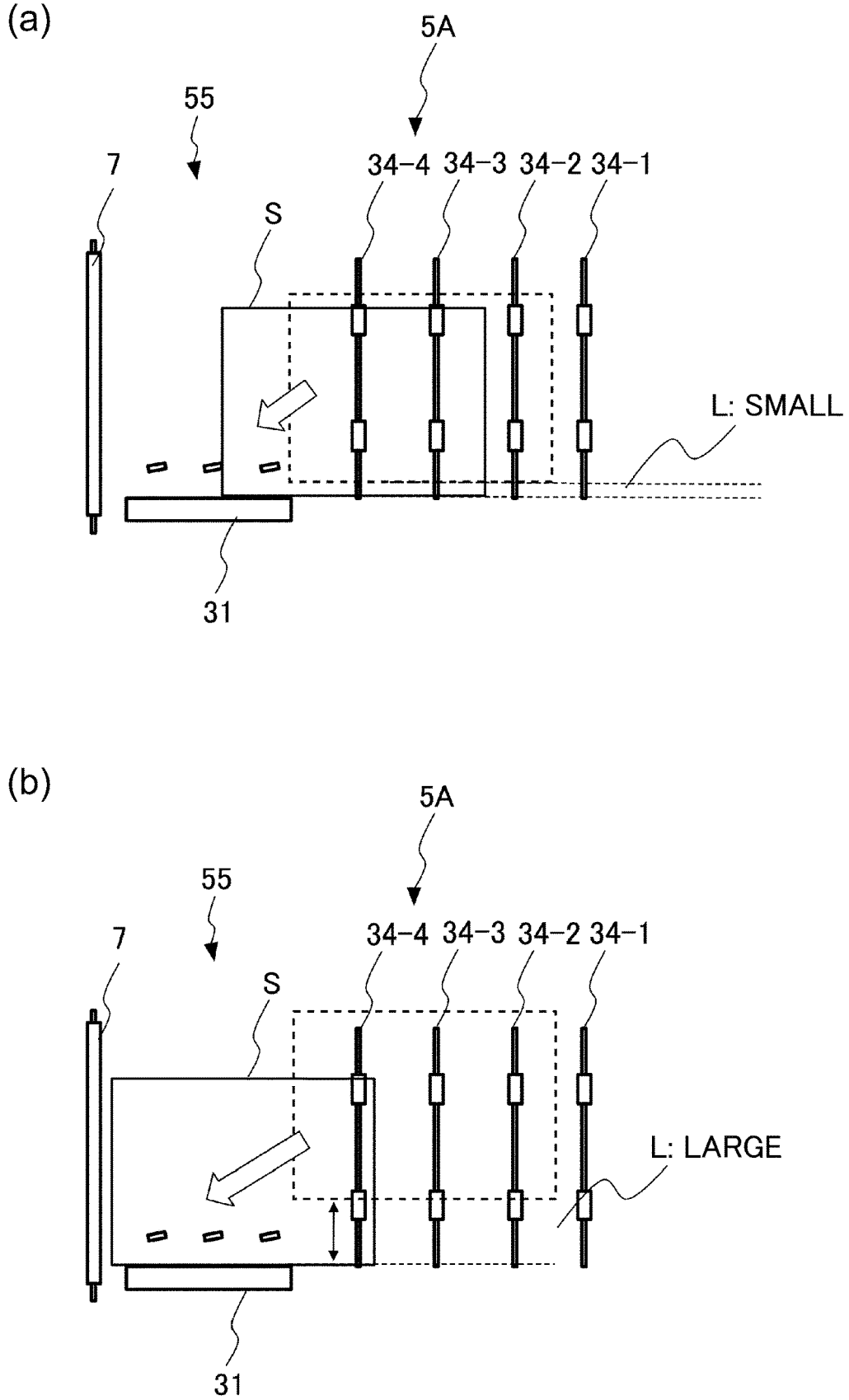

Part (a) of FIG. 5 is a schematic view showing a sheet fed at a position where a distance from a reference member to a side end portion of the sheet is shorter than a distance from the reference member to an obliquely feeding roller in the reference example, and part (b) of FIG. 5 is a schematic view showing a sheet fed at a position where the distance from the reference member to the side end portion of the sheet is longer than the distance from the reference member to the obliquely feeding roller in the reference example.

Figure 6:
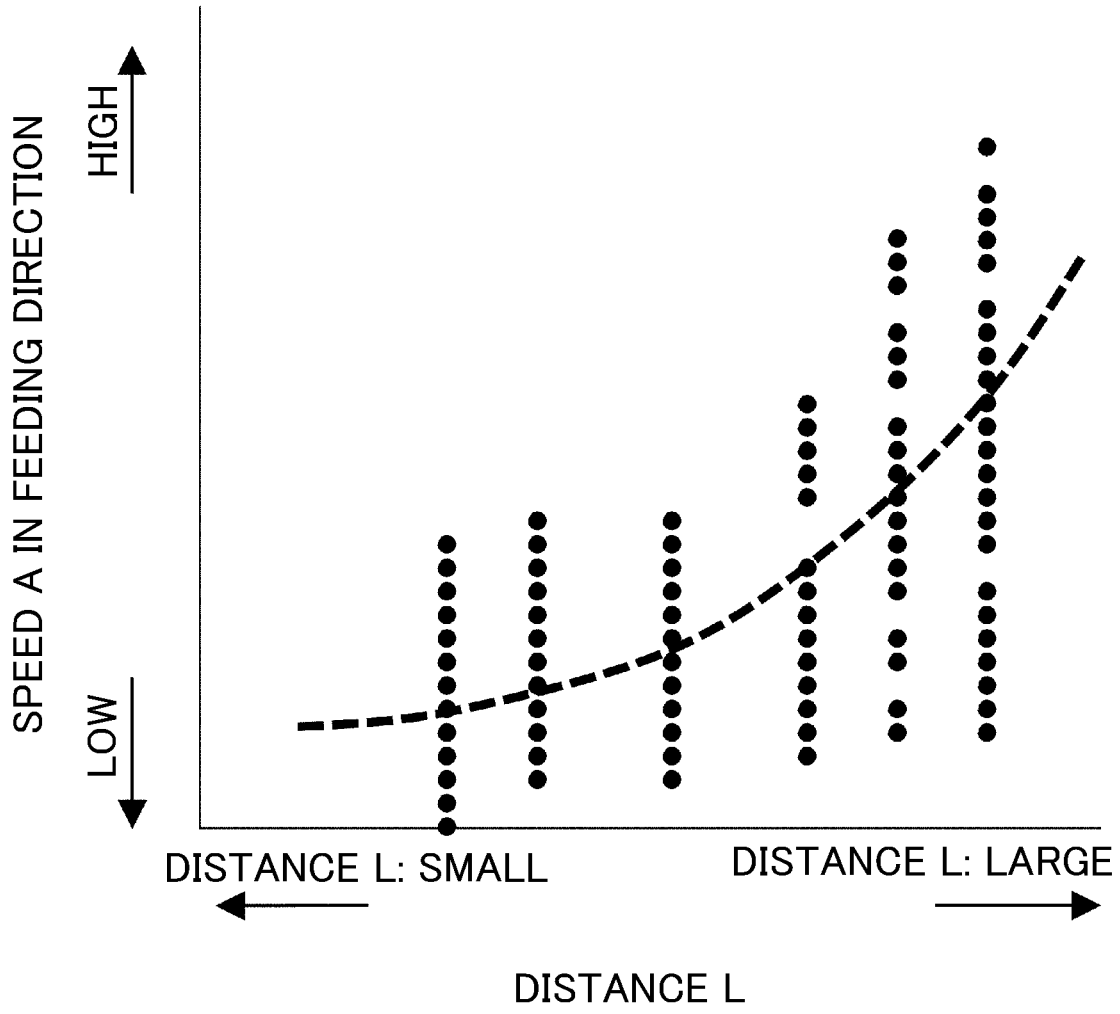

FIG. 6 is a graph (plot) showing a relationship between a change in feeding speed of the sheet during oblique movement correction and a distance L before the oblique movement correction in the reference example.

Figure 7:
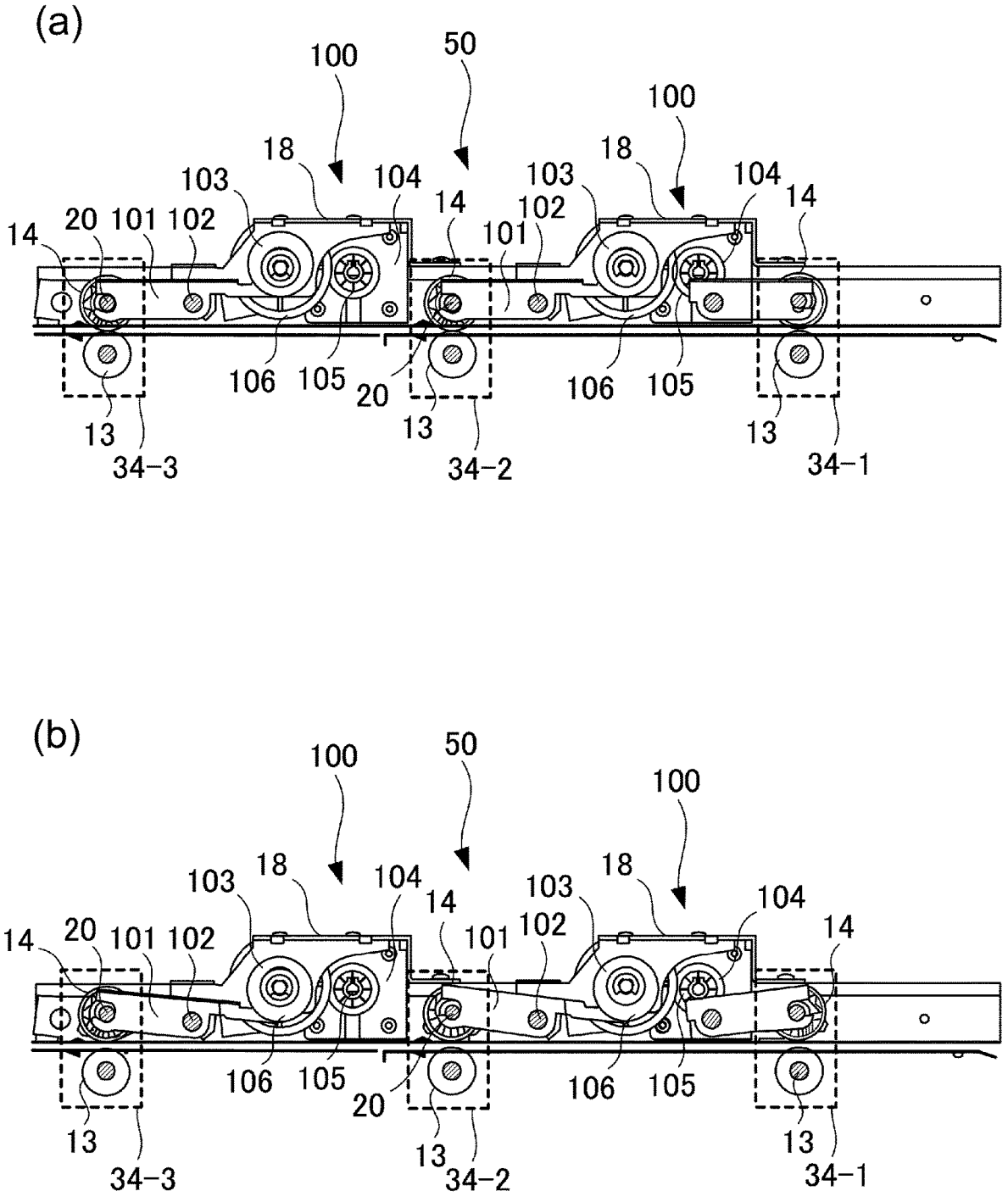

Part (a) of FIG. 7 is a sectional view showing a pressed state by a pressing mechanism in the embodiment 1, and part (b) of FIG. 7 is a sectional view showing a pressure-released state by the pressing mechanism in the embodiment 1.

Figure 8:
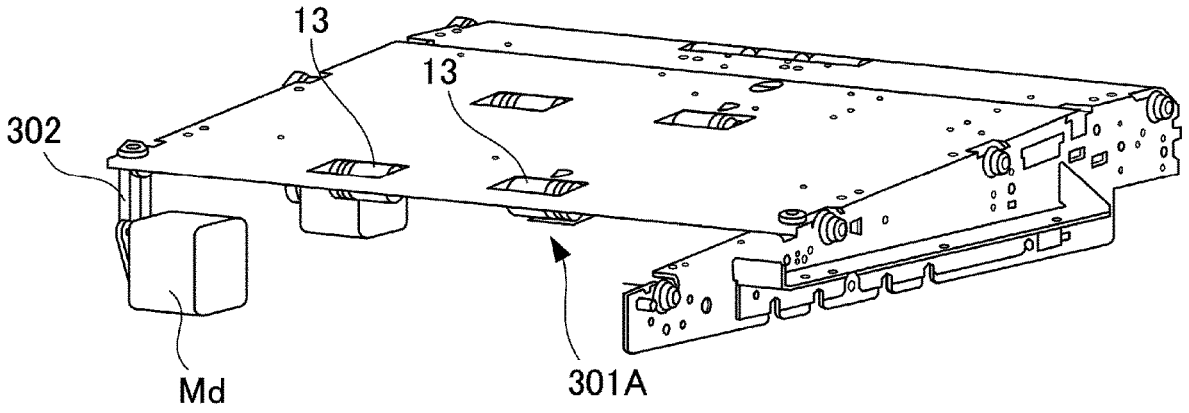

FIG. 8 is a perspective view showing a drive constitution of a feeding portion in the embodiment 1.

Figure 9:
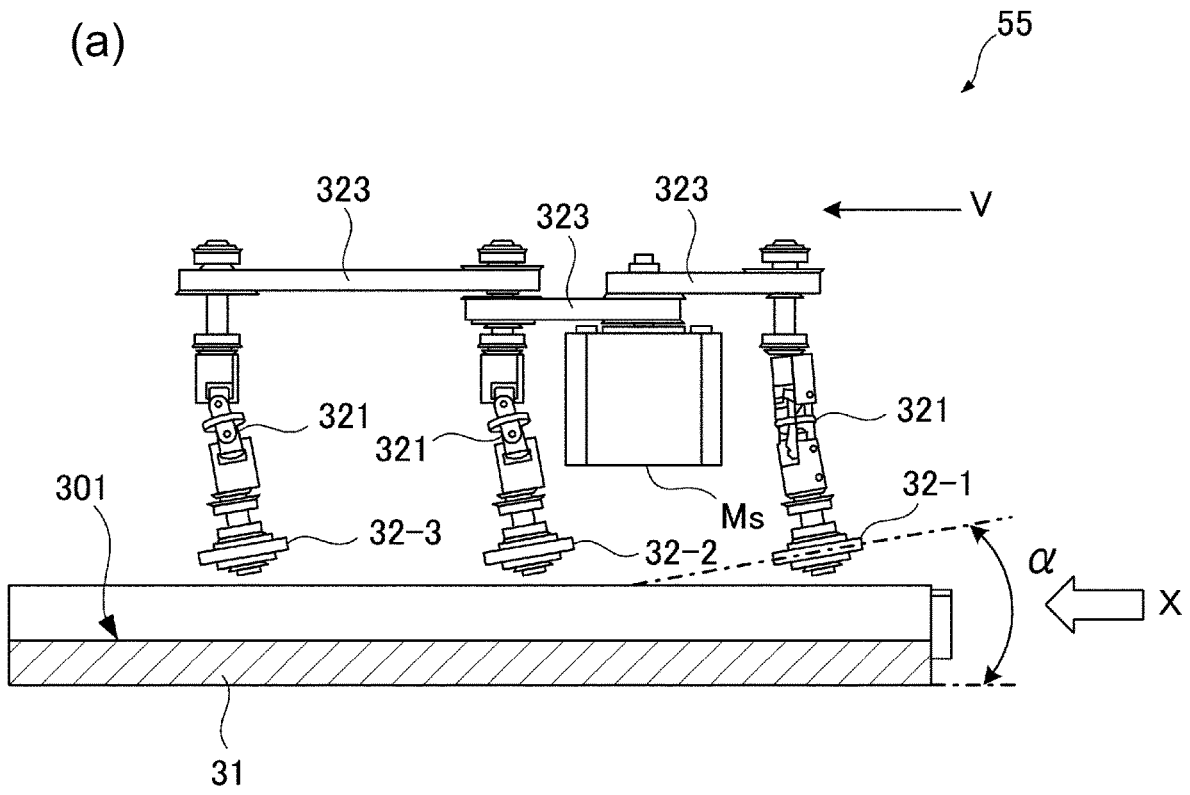
Figure 9:
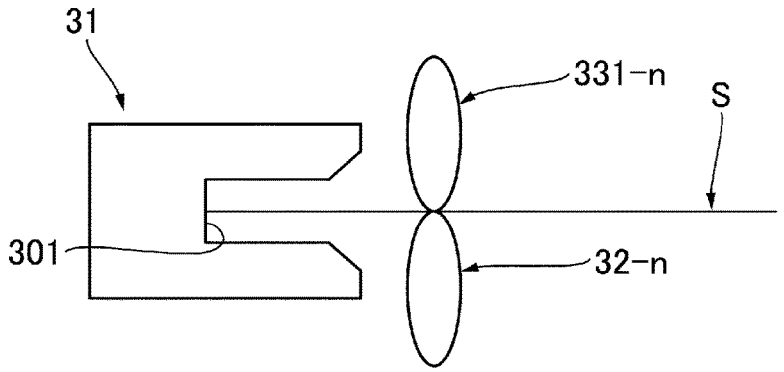

Part (a) of FIG. 9 is a schematic view of an oblique movement correcting portion as seen from above in the embodiment 1, and part (b) of FIG. 9 is a schematic view showing a cross-sectional constitution of a reference member of the oblique movement correcting portion as viewed in a sheet feeding direction in the embodiment 1.

Figure 10:
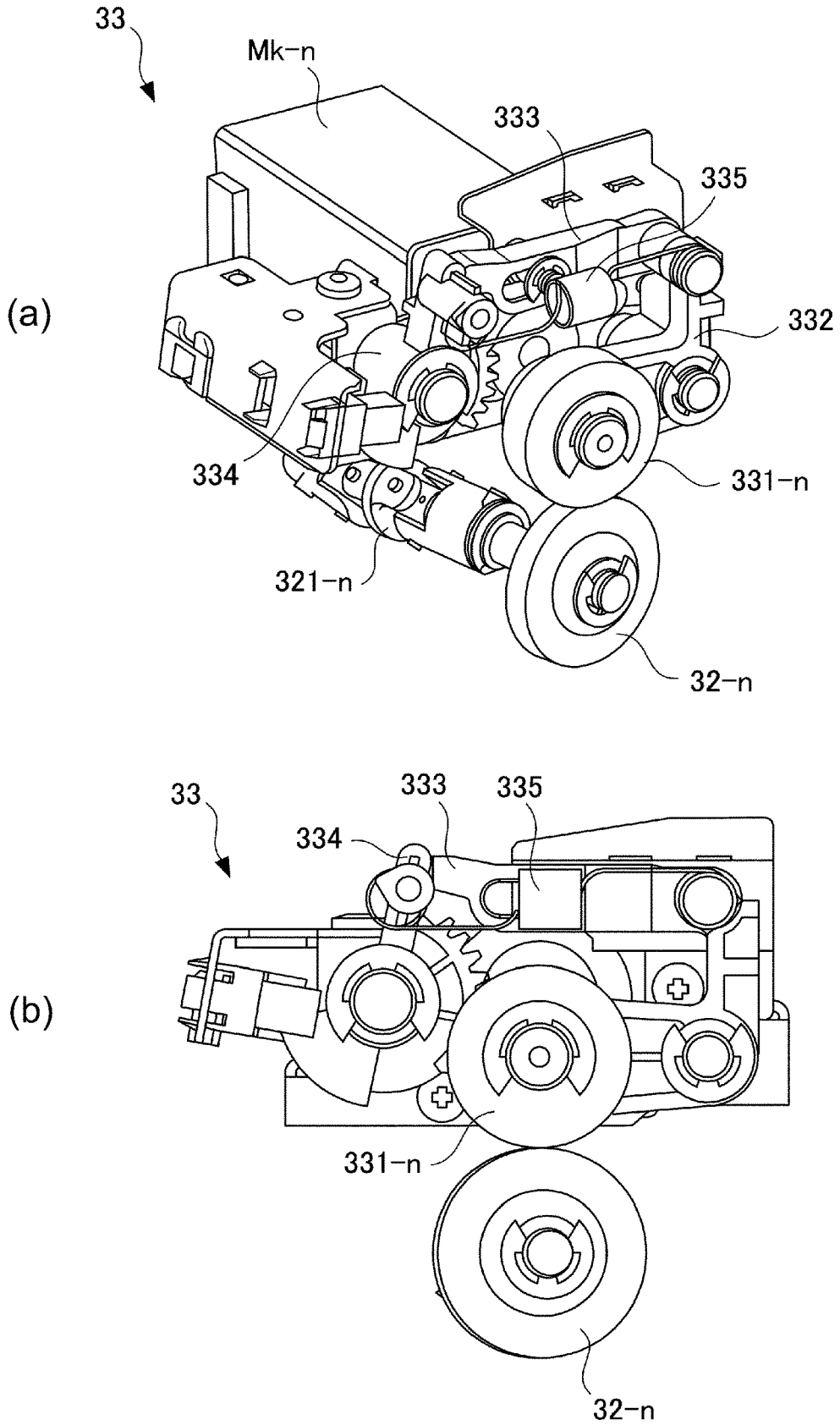

Part (a) of FIG. 10 is a perspective view showing a pressing constitution of a pressing mechanism in the embodiment 1, and part (b) of FIG. 10 is a side view showing the pressing constitution of the pressing mechanism in the embodiment 1.

Figure 11:
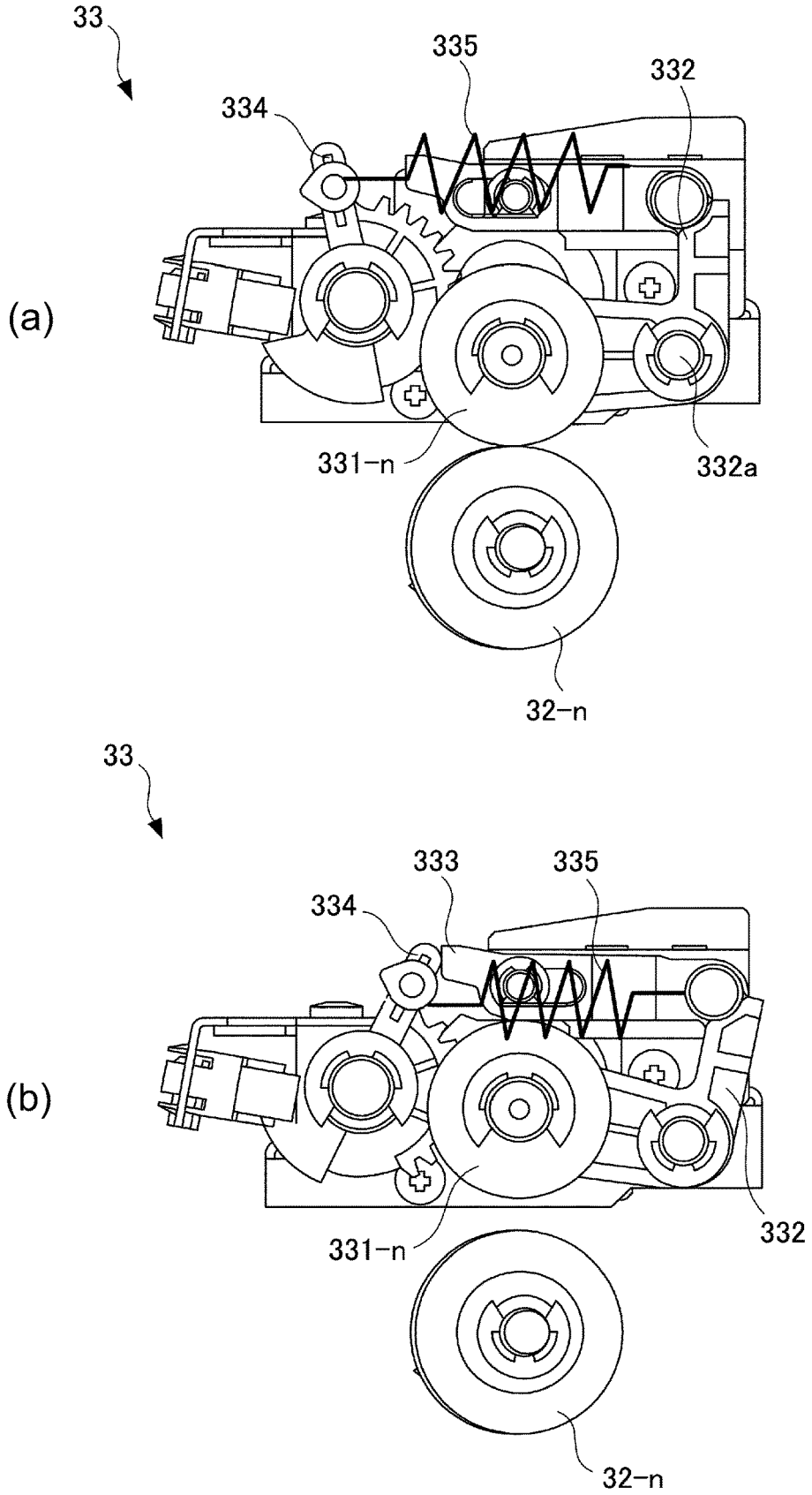

Part (a) of FIG. 11 is a schematic view showing a pressed state by the pressing mechanism in the embodiment 1, and part (b) of FIG. 11 is a schematic view showing a pressure-released state by the pressing mechanism in the embodiment 1.

Figure 12:
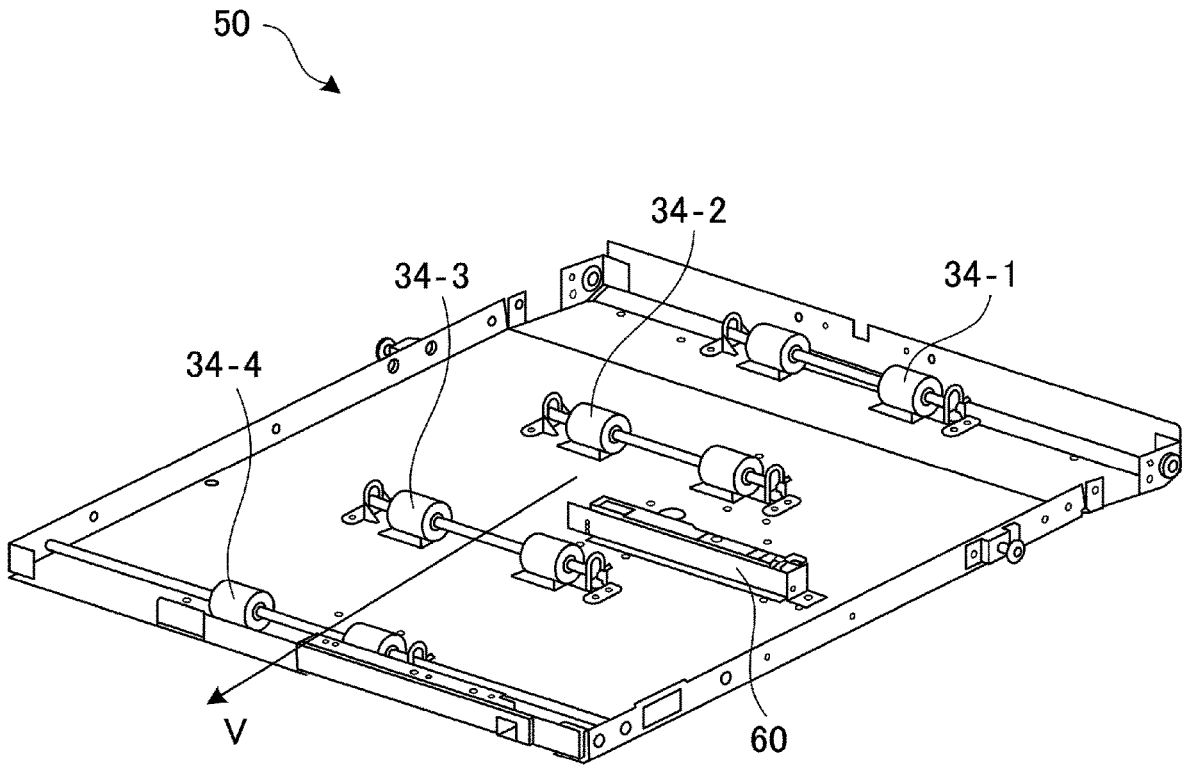

FIG. 12 is a perspective view showing a locating position of a sheet position detecting sensor in the embodiment 1.

Figure 13:
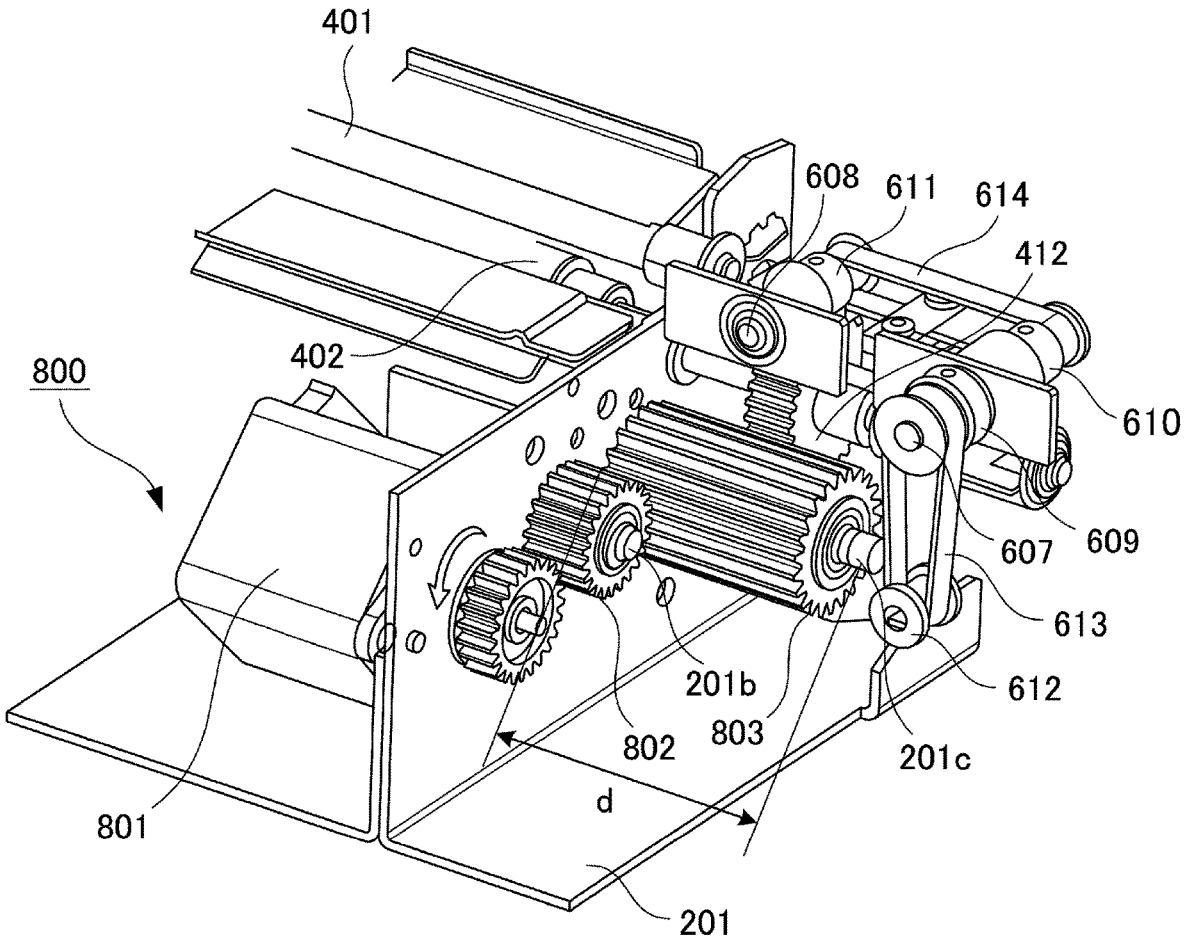

FIG. 13 is a schematic perspective view of a roller driving mechanism for driving a sliding roller in the embodiment 1.

Figure 14:
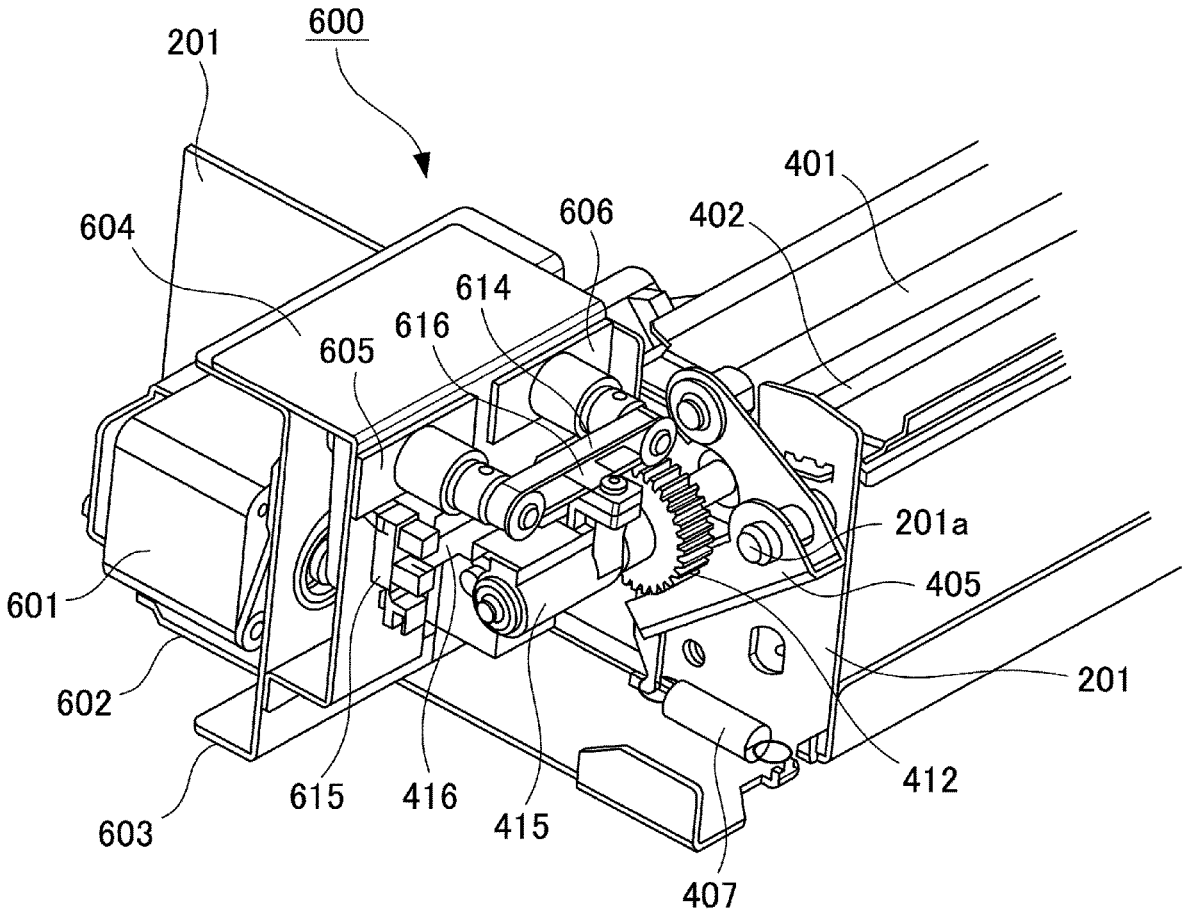

FIG. 14 is a schematic perspective view of a sliding mechanism for the sliding roller in the embodiment 1.

Figure 15:
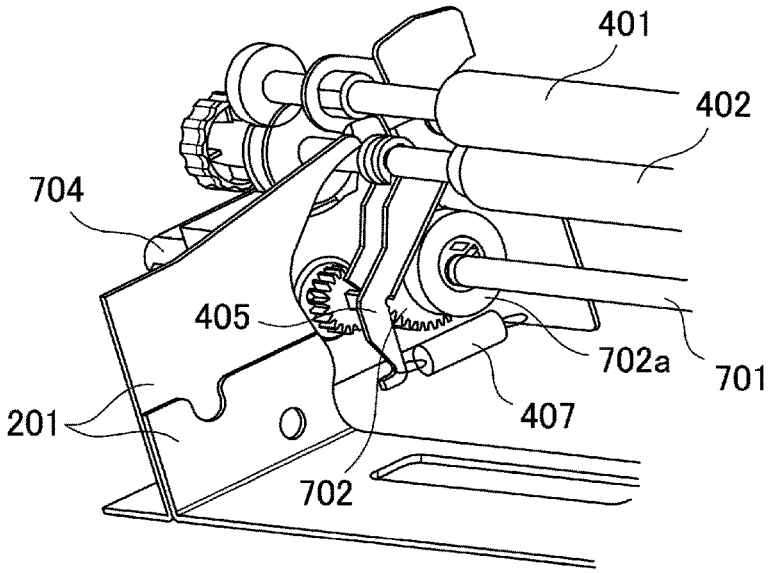
Figure 15:
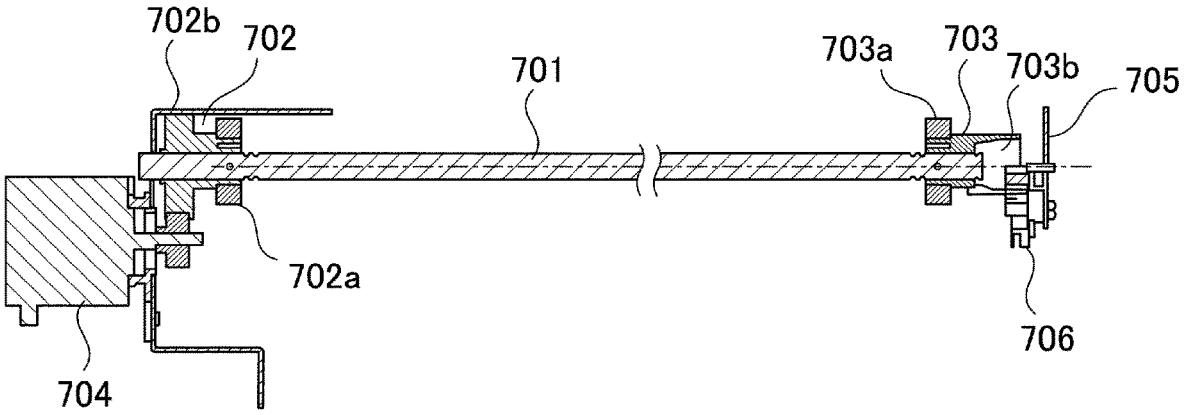

Part (a) of FIG. 15 is an enlarged perspective view of a pressure-releasing mechanism for the sliding roller in the embodiment 1, and part (b) of FIG. 15 is a sectional view of the pressure-releasing mechanism for the sliding roller in the embodiment 1.

Figure 16:
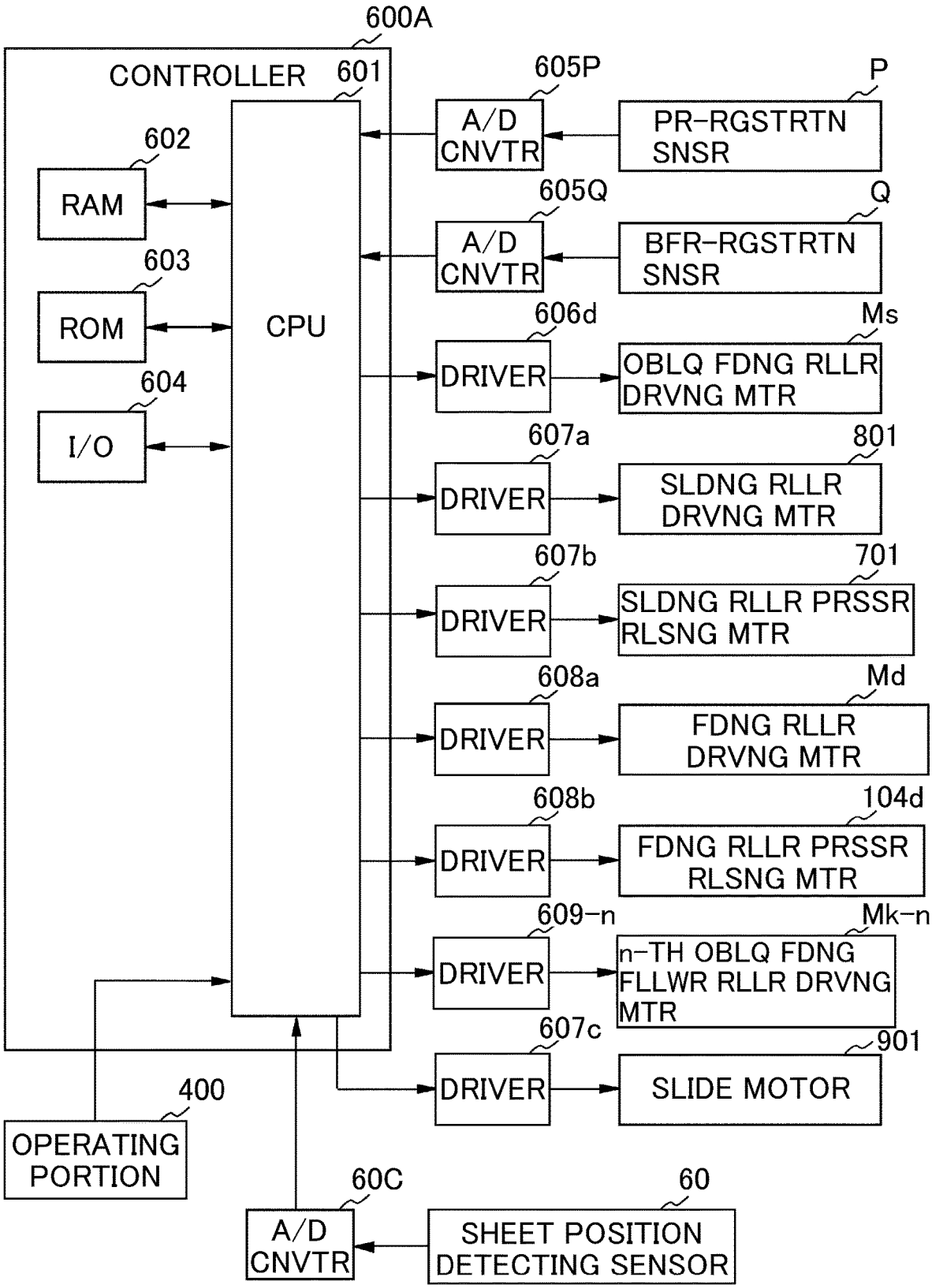

FIG. 16 is a functional block diagram showing a control constitution of a registration portion in the embodiment 1.

Figure 17:
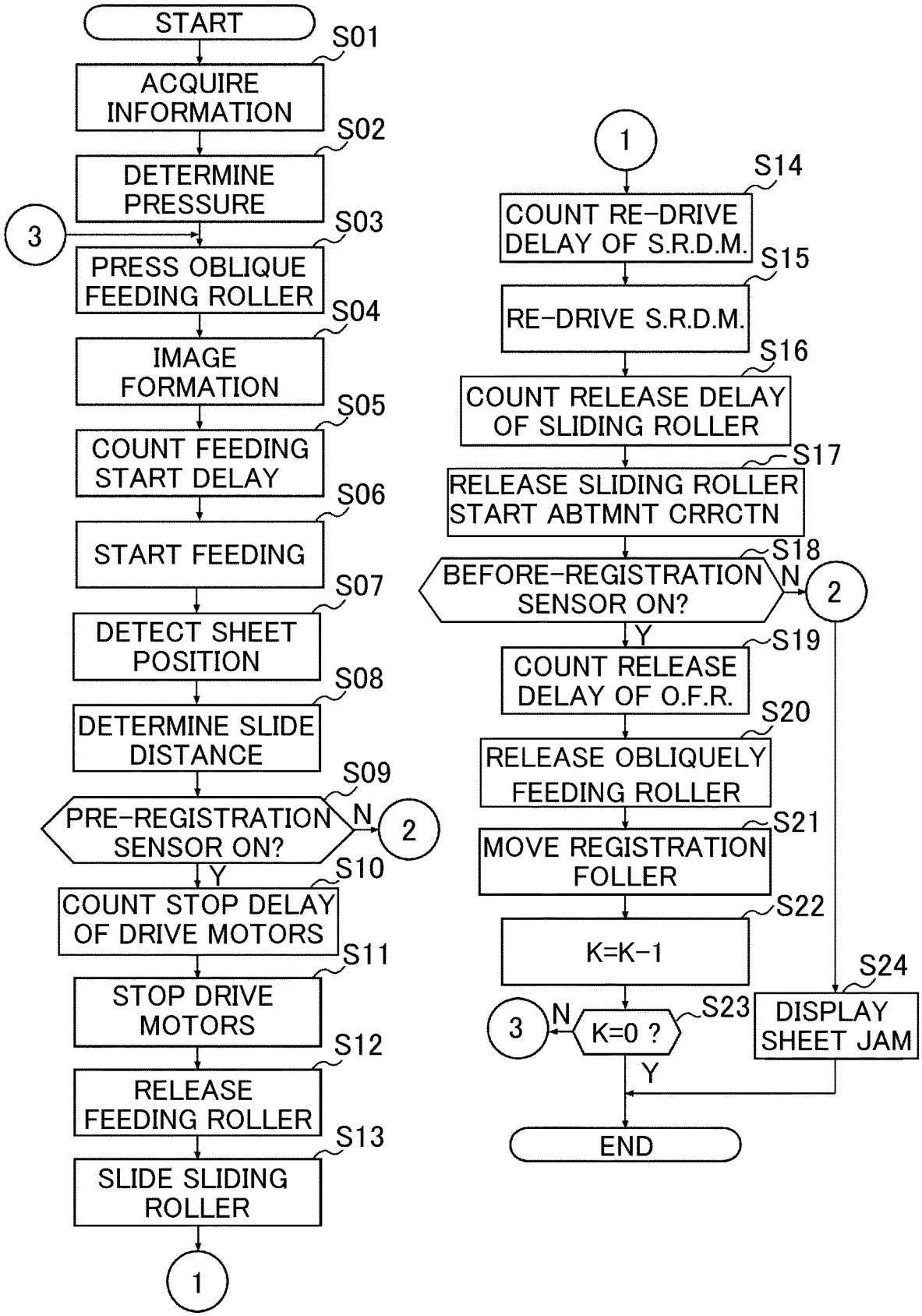

FIG. 17 is a flowchart showing a flow of a sheet feeding operation in the registration portion in the embodiment 1.

Figure 18:
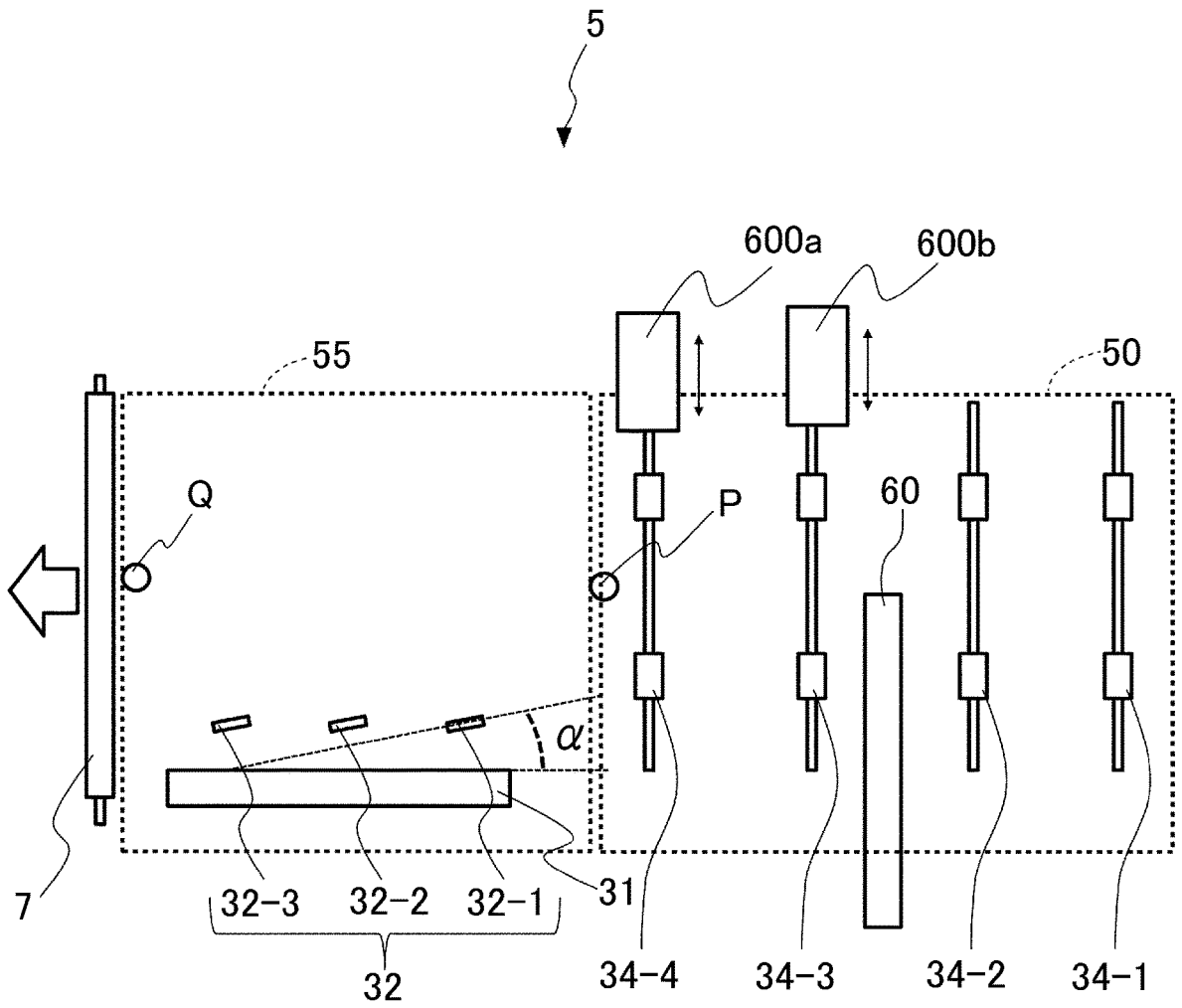

FIG. 18 is a schematic structural view of a registration portion in an embodiment 2.

Figure 19:
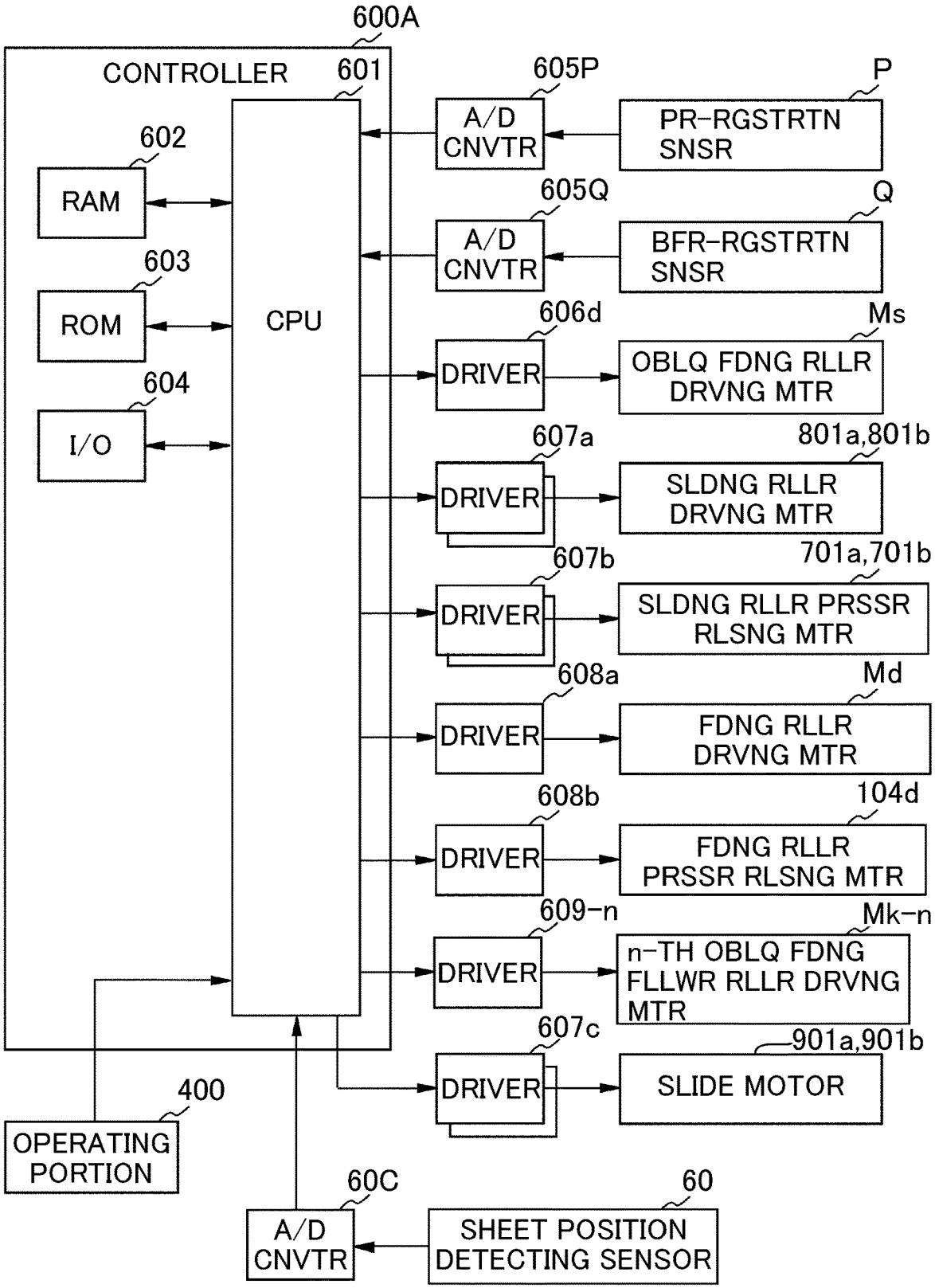

FIG. 19 is a functional block diagram showing a control constitution of the registration portion in the embodiment 2.

Figure 20:
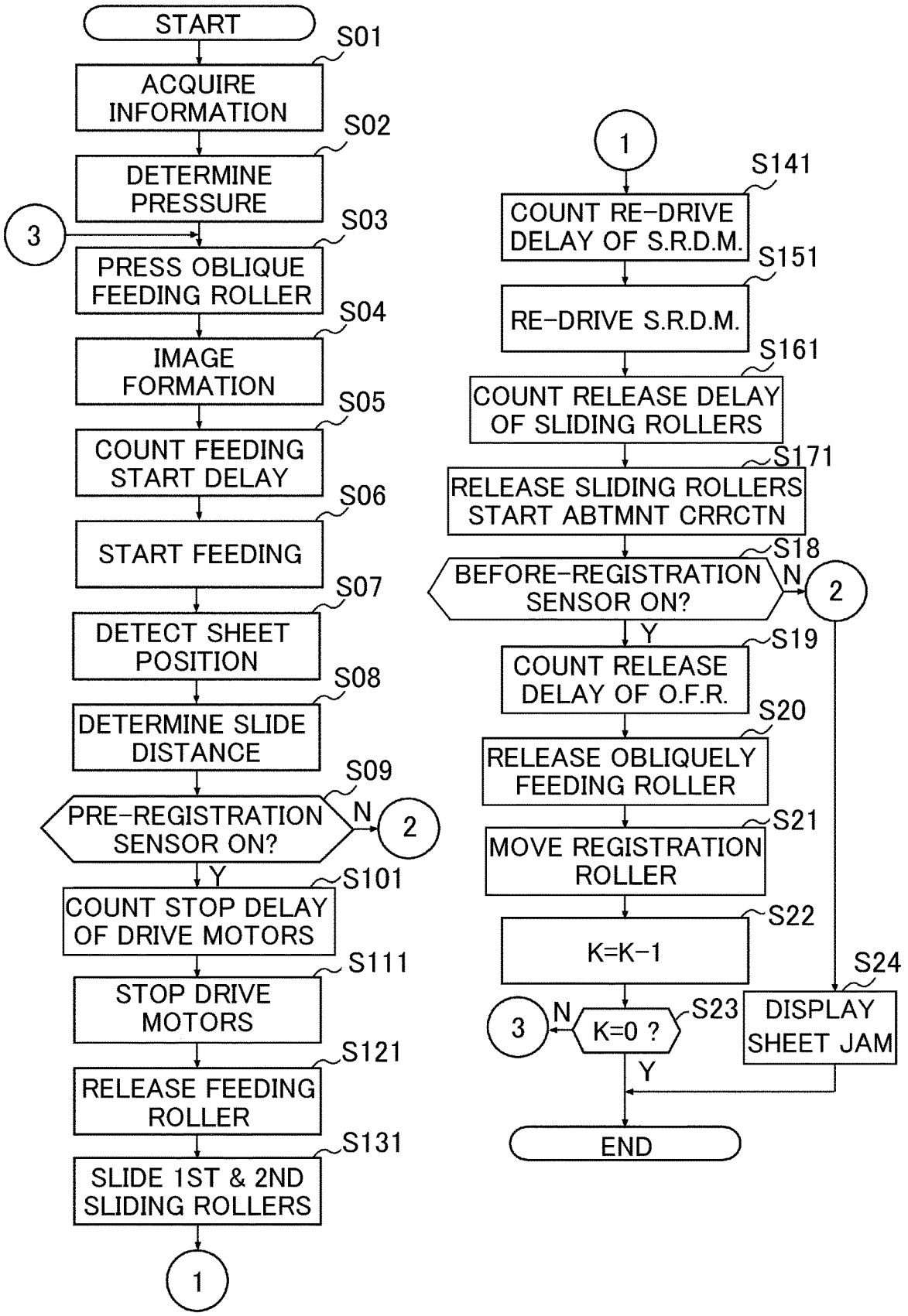

FIG. 20 is a flowchart showing a flow of a sheet feeding operation in the registration portion in the embodiment 2.

Figure 21:
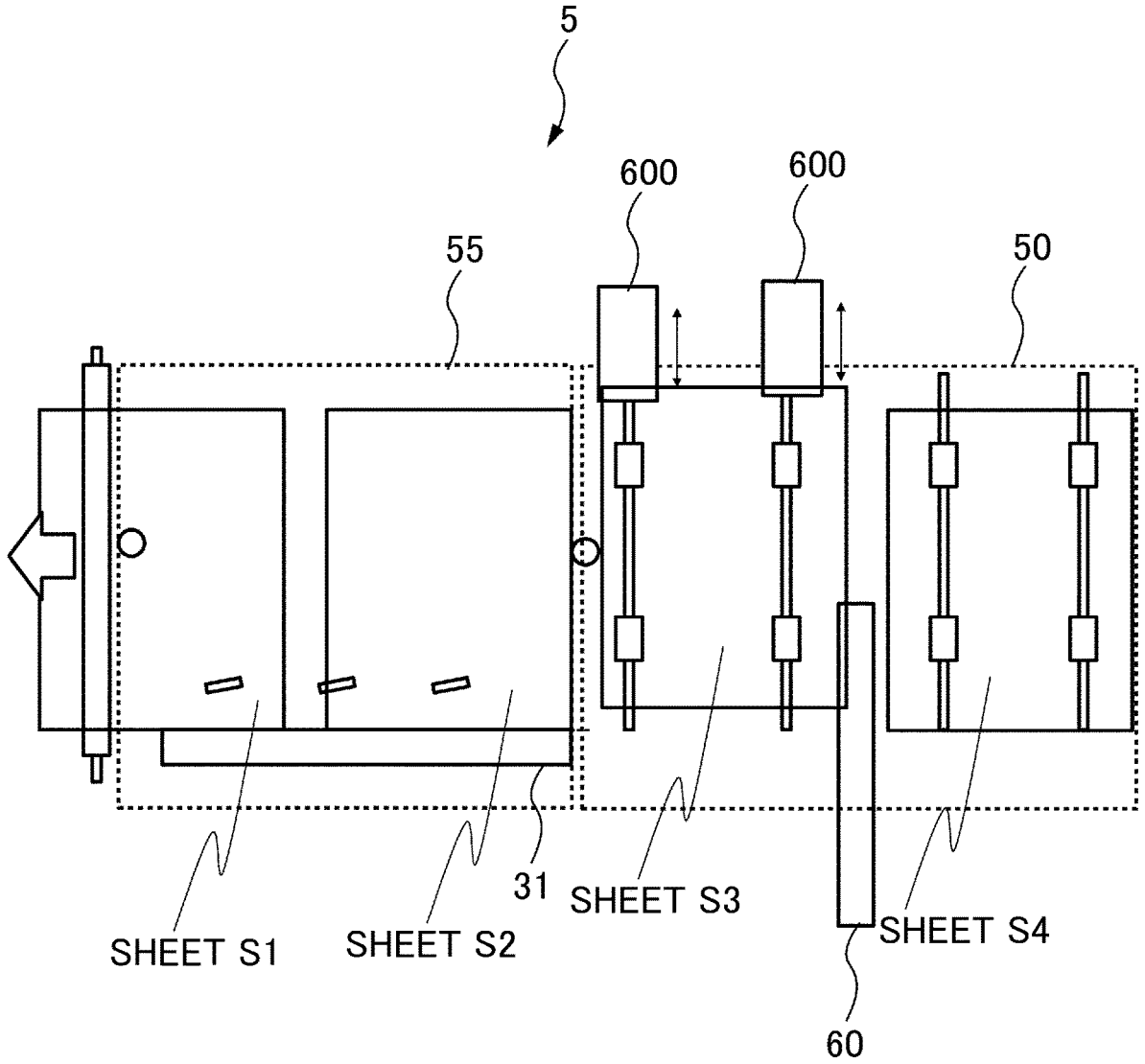

FIG. 21 is a schematic structural view of a registration portion in an embodiment 3.

Figure 22:
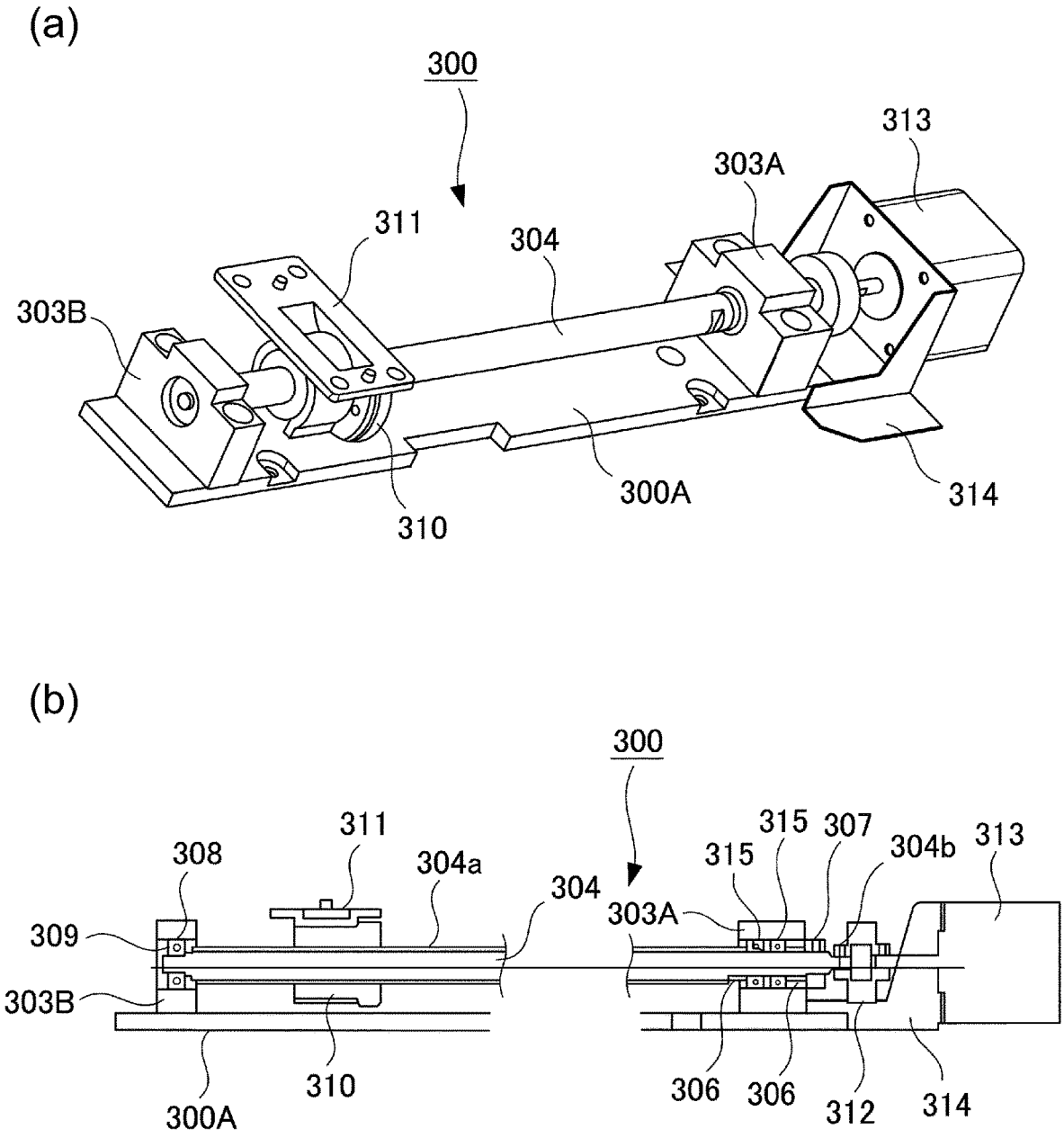

Part (a) of FIG. 22 is a perspective view showing a structure of a reference member moving mechanism in the embodiment 3, and part (b) of FIG. 22 is a sectional view showing a bearing portion of the reference member moving mechanism in the embodiment 3.

Figure 23:
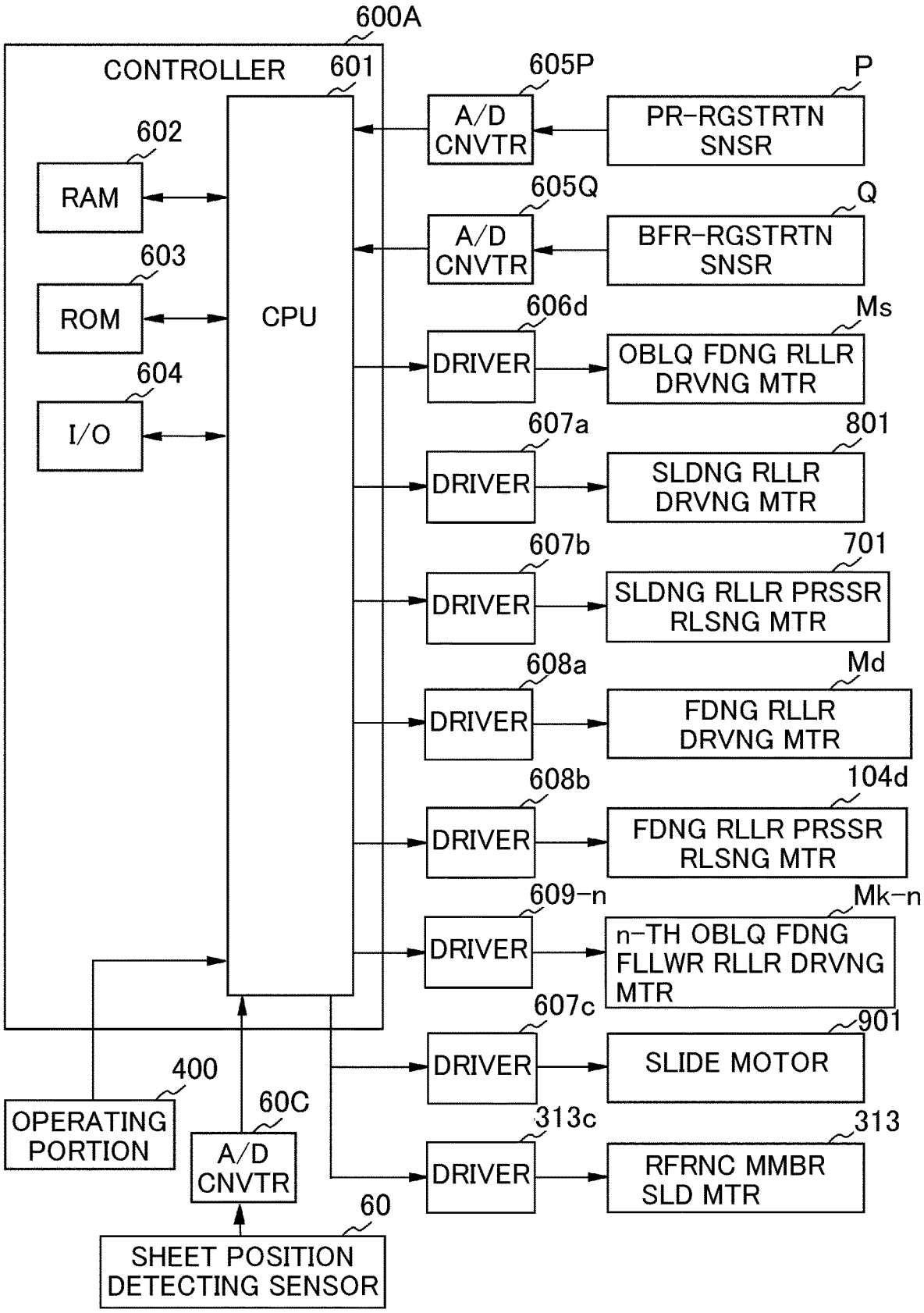

FIG. 23 is a functional block diagram showing a control constitution of the registration portion in the embodiment 3.

Figure 24:
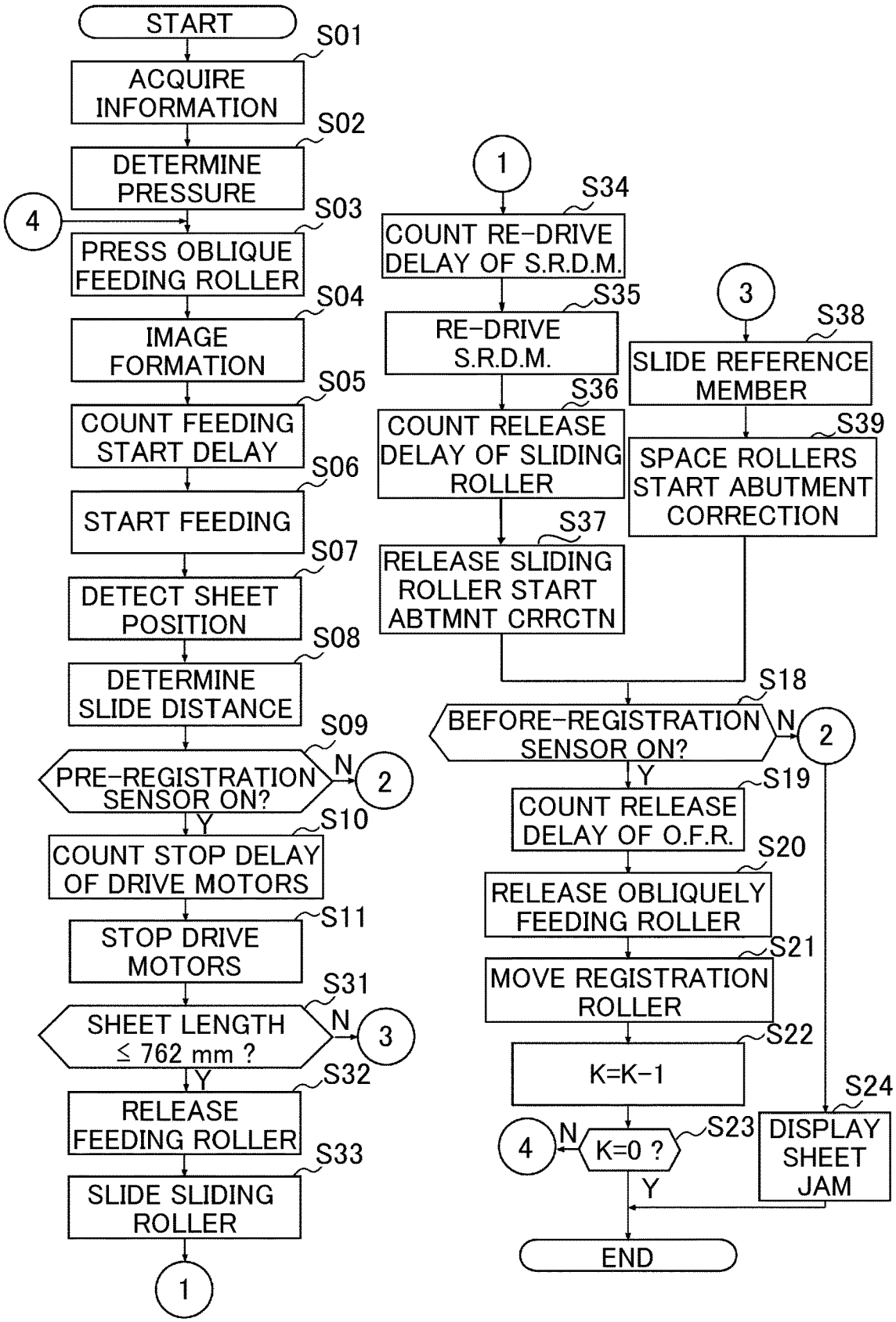

FIG. 24 is a flowchart showing a flow of a sheet feeding operation in the registration portion in the embodiment 3.

DESCRIPTION OF THE EMBODIMENTS

In the following, embodiments for carrying out the present invention will be described with reference to the drawings.

Embodiment 1

<General Structure of Image Forming Apparatus>

Figure 1:
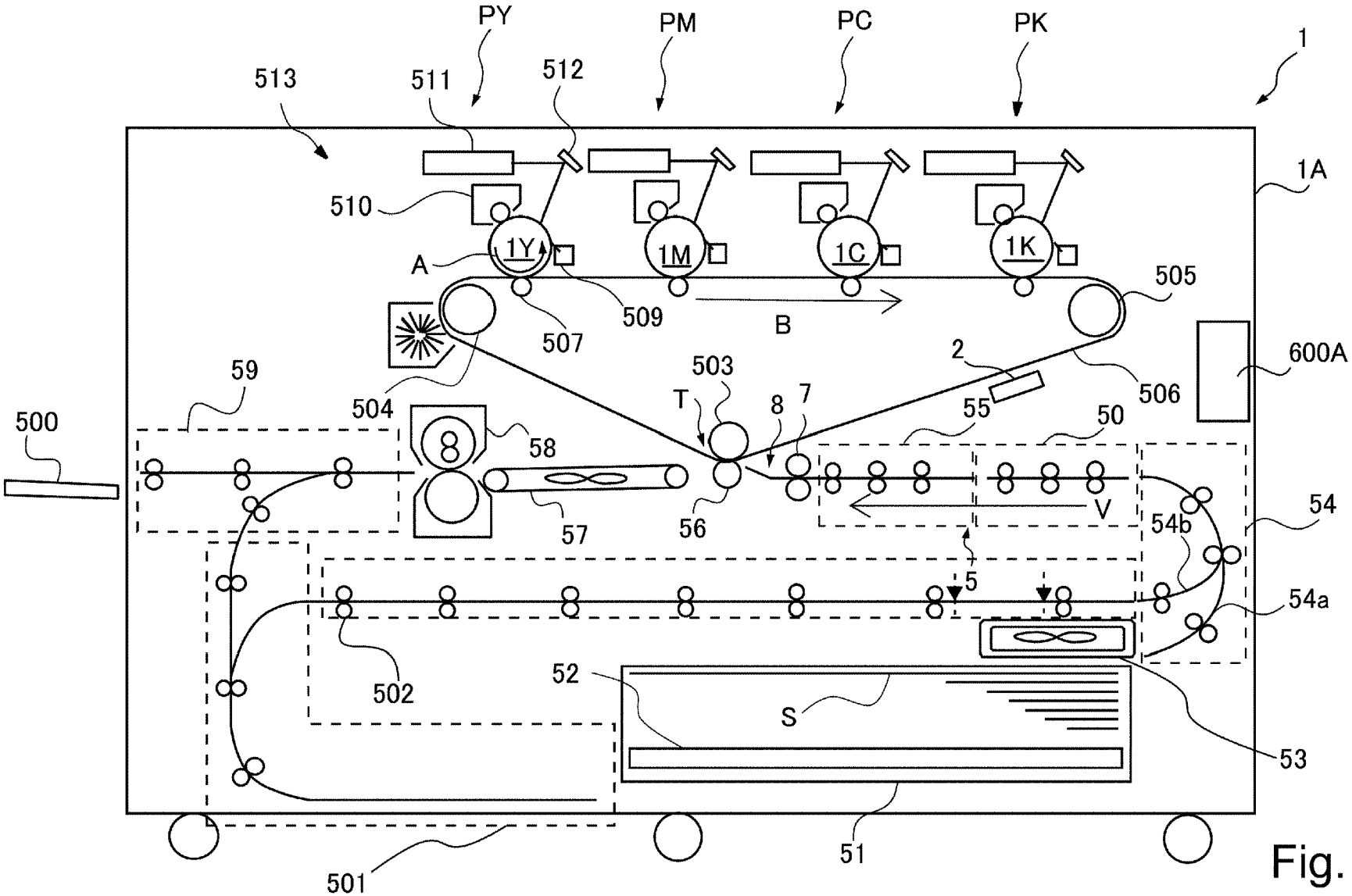
FIG. 1 is a schematic structural view of a printer of an embodiment 1.

First, a schematic structure of a printer 1 as an image forming apparatus of an embodiment 1 will be described. FIG. 1 is a schematic structural view of the printer 1. The printer 1 is an apparatus, such as a printer, a copying machine, a facsimile machine, a multi-function machine, and the like, in which an image is formed on a sheet used as a recording medium (material) on the bases of image information inputted from an external PC or image information read from an original. Further, the printer 1 is capable of meeting printing other than printing for general business purposes, and is capable of using, as the recording medium (material) various sheets including paper such as a form or an envelope, glossy paper, a plastic film such as an overhead projector (OHP) sheet, a cloth and the like.

In an apparatus main assembly 1A of the printer 1, a feeding cassette 51 for accommodating sheets S and an image forming engine 513 for forming an image on the sheet S fed from the feeding cassette 51 are accommodated. The image forming engine 513 which is an example of an image forming means is an engine portion of a tandem intermediary transfer type including four image forming portions PY, PM, PC and PK for forming toner images of yellow, magenta, cyan and black, respectively, and an intermediary transfer belt 506. The image forming portions PY to PK are electrophotographic units including photosensitive drums 1Y, 1M, 1C and 1K, respectively, which are photosensitive members.

The image forming portions PY to PK achieve commonality of constitutions thereof except that colors of toners used for development are different from each other. In this embodiment, a structure and a toner image forming process (image forming operation) of the image forming engine 513 will be described by using the image forming portion PY for yellow as an example. The image forming portion PY includes, in addition to the photosensitive drum 1Y, an exposure device 511, a developing device 510 and a drum cleaner 509. The photosensitive drum 1Y is a drum-shaped photosensitive member including a photosensitive layer at an outer peripheral portion and rotates in a direction (arrow A direction in FIG. 1) along a rotational direction (arrow B direction in FIG. 1) of the intermediary transfer belt 506. A surface of the photosensitive drum 1Y is electrically charged by being supplied with electric charges from a charging means such as a charging roller. The exposure device 511 emits laser light modulated depending on image information, so that the surface of the photosensitive drum 1Y is scanned with the laser light by an optical system including a reflecting device 512 or the like, and thus an electrostatic latent image is formed on the surface of the photosensitive drum 1Y. The developing device 510 accommodates a developer containing the toner and visualizes (develops) the electrostatic latent image into a toner image by supplying the toner to the surface of the photosensitive drum 1Y. The toner image formed on the photosensitive drum 1Y is primary-transferred onto the intermediary transfer belt 506 in a nip (primary transfer portion) between the intermediary transfer belt 506 and a primary transfer roller 507. Residual toner remaining on the photosensitive drum 1Y after the transfer is removed by the drum cleaner 509.

The intermediary transfer belt 506 is extended and wound around a driving roller 504, a follower roller 505, an inner secondary transfer roller 503 and primary transfer roller 507, and is rotationally driven in the clockwise direction (arrow B direction) in FIG. 1 by the driving roller 504. The image forming operation described above is performed in the image forming portions PY to PK in parallel, and the four color toner images are transferred in a multiple-transfer manner so as to be superposed on each other, so that a full-color image is formed on the intermediary transfer belt 506. These toner images for the full-color image are fed to a secondary transfer portion T by being carried on the intermediary transfer belt 506. The secondary transfer portion T is constituted as a nip between a secondary transfer roller 56 as a transfer means and the inner secondary transfer roller 503. To the secondary transfer roller 56, a bias voltage of a polarity opposite to a charge polarity of the toner is applied. By this, the toner images are secondary-transferred onto the sheet S. Residual toner remaining on the intermediary transfer belt 506 after the transfer is removed by a belt cleaner.

The sheet S on which the toner image is transferred is delivered to a fixing unit 58 by a pre-fixing feeding portion 57. The fixing unit 58 includes a fixing roller pair for feeding the sheet S while nipping the sheet S and a heat source such as a halogen heater, and applies heat and pressure to the toner image carried on the sheet S. By this, toner particles are melted and fixed, so that the toner image is fixed on the sheet S.

Next, a structure and an operation of a sheet feeding system for feeding the sheet S accommodated in the feeding cassette 51 and for discharging the sheet S, on which the image is formed, to an outside of the apparatus main assembly 1A will be described. The sheet feeding system includes a sheet feeding portion 54, a feeding (conveying) portion 50, an oblique movement correcting portion 55, a branch feeding (conveying) portion 59, a reverse feeding (conveying) portion 501, and a double-side feeding (conveying) portion 502.

The feeding cassette 51 is mounted in the apparatus main assembly 1A so as to be capable of being pulled out and in which the sheets S are accommodated in a stacked state on a raising and lowering plate 52 which is capable of being raised and lowered. The sheets S are fed one by one by the feeding unit 53. As a type of the feeding unit 53 which is a sheet feeding means, it is possible to cite a belt type (see FIG. 1) in which the sheet S is attracted to a belt member by a suction fan and then is fed and a friction separation type using a roller or a pad. The sheet S fed from the feeding unit 53 is fed along a feeding passage 54*a* by a feeding roller pair and passes through the feeding portion 50, and then is delivered to the oblique movement correcting portion 55.

The sheet S delivered to oblique movement correction and timing correction in the oblique movement correcting portion 55 and then is fed toward the secondary transfer portion T. At this time, a registration roller pair 7 which is a second feeding roller pair included in the oblique movement correcting portion 55 sends the sheet S to the secondary transfer portion T at timing synchronized with a degree of progress of the image forming operation by the image forming portions PY to PK, on the bases of a detection signal of a registration sensor 8. The sheet S on which the toner image is transferred in the secondary transfer portion T and on which the image is fixed by the fixing unit 58 is fed to the branch feeding portion 59 including a switching member capable of switching a feeding passage of the sheet S. In the case where the image formation on the sheet S is completed, the sheet S is discharged by a discharging roller pair onto the discharge tray 500 disposed outside the apparatus main assembly 1A. In the case where the image is formed on a back surface (side) of the sheet S, the sheet S is delivered to the double-side feeding portion 502 through the reverse feeding portion 501. The reverse feeding portion 501 includes a reverse roller pair capable of being rotated normally and reversely and subjects the sheet S to switchback, and then delivers the sheet S to the double-side feeding portion 502. The double-side feeding portion 502 feeds the sheet S toward the feeding portion 50 through a re-feeding passage 54*b* merging with a feeding passage 54*a*. After the image is formed on the back surface of the sheet S, the sheet S is discharged onto the discharge tray 500.

Incidentally, the above-described constitution is an example of the image forming apparatus, and for example, the image forming apparatus may also be an image forming apparatus provided with an image forming means of an ink jet type in place of the electrophotographic type. Further, there is an image forming apparatus provided with an additional (optional) equipment, such as an option feeder or a sheet processing device, in addition to the apparatus main assembly provided with the image forming means, but a constitution of a sheet feeding device described below may also be used for feeding the sheet in such additional equipment.

<Schematic Constitution of Registration Portion>

Figure 2:
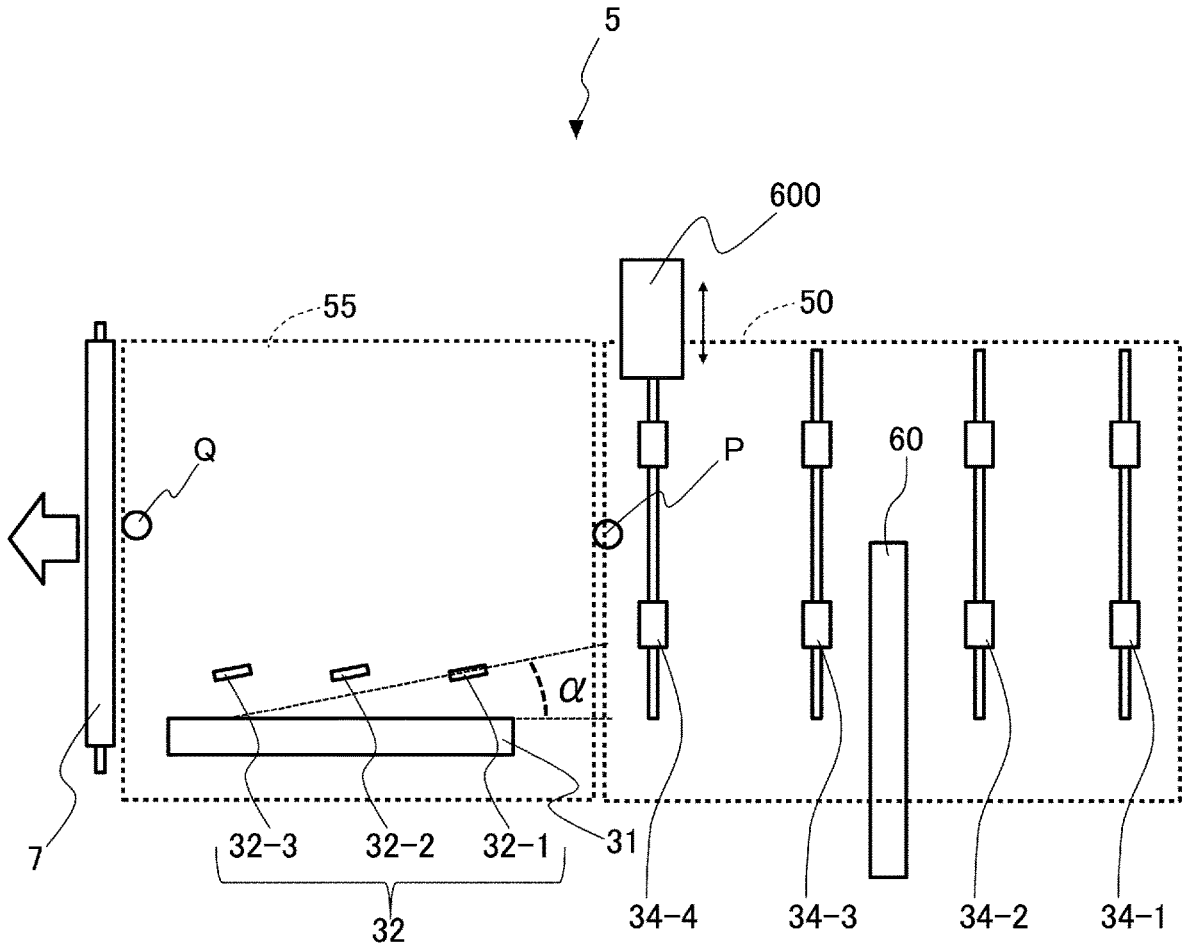
FIG. 2 is a schematic structural view of a registration portion in the embodiment 1.

Next, a constitution of a registration portion 5 constituting the sheet feeding device will be described with reference to FIG. 2. FIG. 2 is a schematic structural view of the registration portion 5. Incidentally, FIG. 2 shows a constitution (structure) of the registration portion 5 as seen from above the apparatus main assembly 1A (see FIG. 1). As shown in FIG. 2, the registration portion 5 includes the feeding portion 50 for feeding the sheet in the sheet feeding direction and the oblique movement correcting portion 55 disposed downstream of the feeding portion 50 with respect to the sheet feeding direction. Further, the registration portion 5 includes a sheet position detecting sensor 60 for detecting a position of an end portion of the sheet with respect to a widthwise direction perpendicular to the sheet feeding direction and a sliding mechanism 600 for moving a roller constituting the feeding portion 50 in the widthwise direction perpendicular to the sheet feeding direction. The feeding portion 50 at least includes a pair of feeding rollers, and FIG. 2 shows a constitution provided with feeding rollers 34-1, 34-2, 34-3, and 34-4. In the following description, when there is no need of distinction between the feeding rollers 34-1, 34-2, 34-3, and 34-4, these feeding rollers are referred to as "feeding rollers 34". The feeding rollers 34 feeds (sends) the sheet in the sheet feeding direction. Incidentally, in the registration portion 5, the feeding roller 34-4 is provided with the sliding mechanism 600. Further, in FIG. 2, a constitution in which the sheet position detecting sensor 60 capable of detecting a side end position is disposed at a position between the feeding rollers 34-2 and 34-4 is shown as an example. The sheet position detecting sensor 60 can also be disposed at a position, other than the position of FIG. 2, where a widthwise end portion of the sheet fed through the feeding portion 50 is detectable, for example, at a position between the feeding rollers 34-4 and 34-3.

The oblique movement correcting portion 55 is provided with obliquely feeding rollers 32-1, 32-2, and 32-3, a reference member 31, and a registration roller pair 7. In the following description, there is no need of distinction between the obliquely feeding rollers 32-1, 32-2, and 32-3, these obliquely feeding rollers are referred to as "obliquely feeding rollers 32". The reference member 31 includes a reference surface 301 (see part (b) of FIG. 9) extending in the sheet feeding direction and is disposed on either one of opposite sides of a sheet feeding passage with respect to the widthwise direction of the sheet perpendicular to the sheet feeding direction. The reference surface 301 extends along the sheet feeding direction and corresponds to a contact surface contactable to one end of the sheet with respect to the widthwise direction, i.e., a side end of the sheet.

In the neighborhood of the feeding roller 34-4, a pre-registration sensor P for detecting passing of the sheet is provided. As the pre-registration sensor P, for example, a photoelectric sensor of a reflection type including a light emitting portion and a light receiving portion can be used. In this case, light emitted from the light emitting portion is reflected by the sheet which reached a detecting position, and the reflected light is detected by the light receiving portion, so that a sheet passing timing is detected. In FIG. 2, the pre-registration sensor P is disposed between the feeding roller 34-4 and the obliquely feeding roller 32-1 with respect to the sheet feeding direction.

Each of the obliquely feeding rollers 32-1, 32-2, and 32-3 is rotated about an axis inclined with respect to the widthwise direction. That is, the obliquely feeding rollers 32-1, 32-2, and 32-3 are disposed in parallel to each other so that a tangential direction at a contact portion to the sheet is a direction inclined relative to the sheet feeding direction at an angle α. Accordingly, the obliquely feeding rollers 32-1, 32-2, and 32-3 are rotated in contact with the sheet, whereby these obliquely feeding rollers move the sheet so as to approach the reference surface 301 of the reference member 31 with respect to the widthwise direction as the sheet is fed toward a downstream side of a sheet feeding direction V. Further, the sheet moves so as to approach the reference surface 301 as the sheet is fed toward the downstream side of the sheet feeding direction V.

Here, oblique movement correction of the sheet by the oblique movement correcting portion 55 will be described. The oblique movement correcting portion 55 corrects oblique movement of the sheet by a so-called side registration type. Specifically, the oblique movement correcting portion 55 brings a side end of the sheet, i.e., a sheet end portion with respect to the widthwise direction into contact with the reference member 31 having the reference surface 301 which is the contact surface extending along the sheet feeding direction. Then, after the sheet contacts the reference surface 301, the oblique movement of the sheet is corrected by moving the side end of the sheet along the reference surface 301. Incidentally, the sheet feeding direction is a sheet advance direction before the sheet approaches the reference member 31 in the oblique movement correcting portion 55, and in this embodiment, refers to a feeding direction of the sheet by the feeding rollers 34 of the feeding portion 50.

Further, in the oblique movement correcting portion 55, in addition to the pre-registration sensor P, a before-registration sensor Q is provided. The before-registration sensor Q is disposed downstream of the obliquely feeding rollers 32 and upstream of the registration roller pair 7 with respect to the sheet feeding direction. As the before-registration sensor Q, similarly as the pre-registration sensor P, a known sensor such as the photoelectronic sensor of the reflection type can be used.

The registration roller pair 7 is slidable in the sheet widthwise direction perpendicular to the sheet feeding direction in a state in which the sheet is nipped. The registration roller pair 7 moves the sheet, contacted at the side end thereof to the reference surface 301 of the reference member 31, in the widthwise direction in conformity to a position of an image to be transferred in the secondary transfer portion T. By this, the sheet moves so that a widthwise center of the sheet subjected to oblique movement correction in the registration portion 5 is a designed feeding center of the printer 1. Further, a method of positionally aligning the sheet with the image to be formed on the sheet is not limited thereto, but for example, a constitution in which positions of the reference member 31 and the registration roller pair 7 with respect to the widthwise direction are fixed and positions of toner images formed by the image forming portions PY to PK are adjusted may also be employed.

Figure 3:
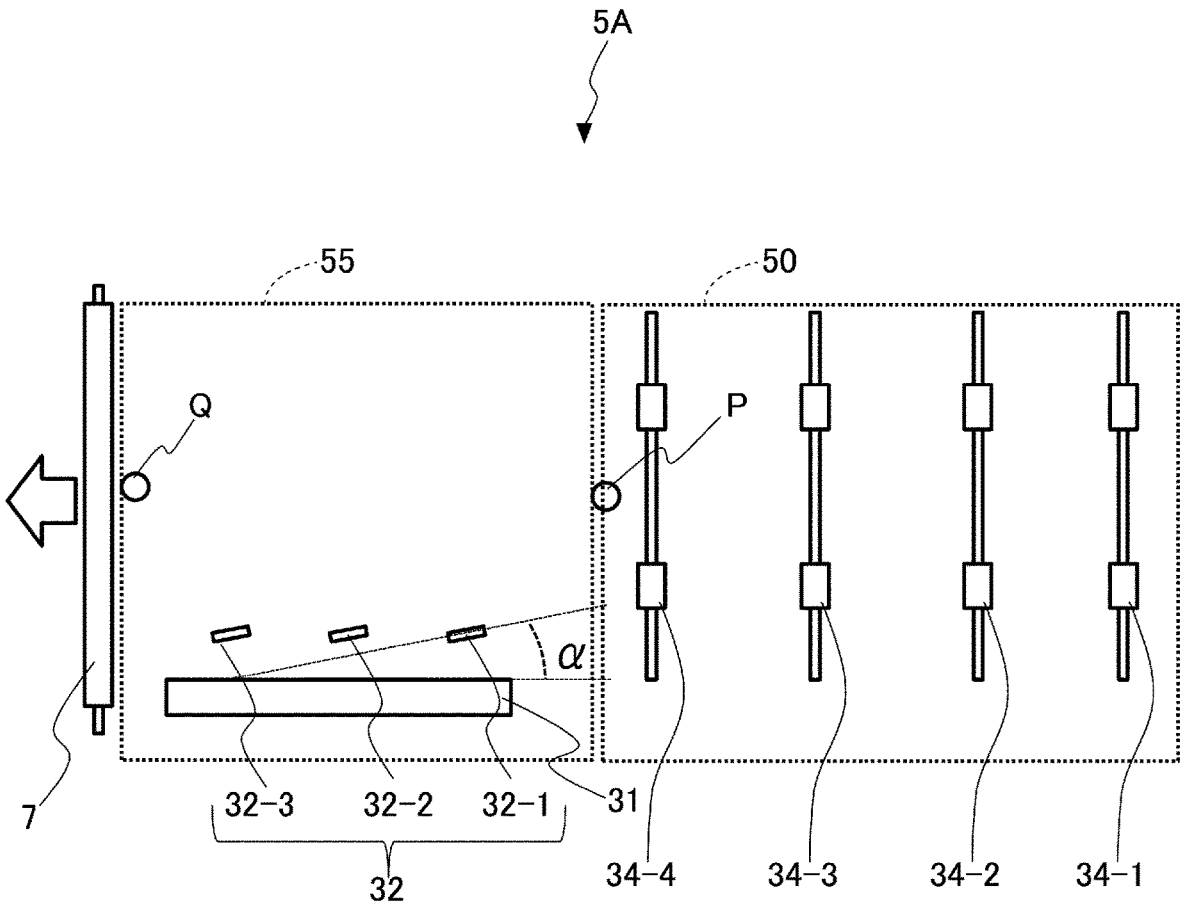
FIG. 3 is a schematic structural view of a conventional registration portion as a reference example.

Next, as a reference example, by taking a constitution of a conventional registration portion 5A as an example, a change in feeding speed of the sheet during the oblique movement correction will be described. FIG. 3 is a schematic view showing a schematic structure of the conventional registration portion 5A in the reference example. The registration portion 5A has a constitution in which the sliding mechanism 600 and the sheet position detecting sensor 60 are omitted from the registration portion 5 in this embodiment. That is, the registration portion 5A corresponds to a constitution in which with respect to the registration portion 5, the constitution of moving the roller constituting the feeding portion 50 in the widthwise direction of the sheet perpendicular to the sheet feeding direction is not provided. For that reason, in FIG. 3, constituent elements overlapping with those of the registration portion 5 are represented by the same reference numerals or symbols as in FIG. 2 and will be omitted from redundant description.

Figure 4:
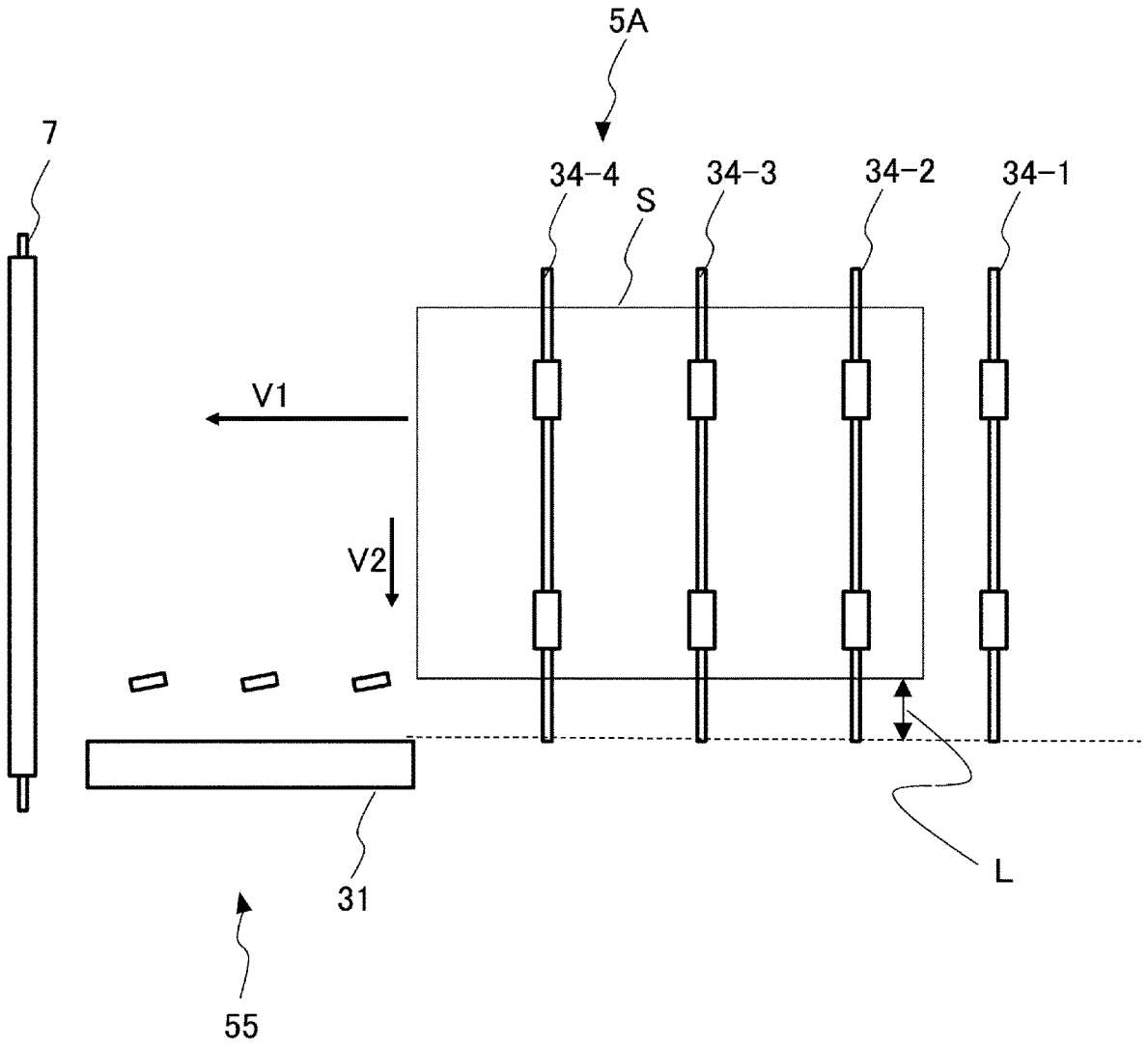
FIG. 4 is a schematic view showing speed components of a sheet fed through the registration portion in the reference example.

Further, FIG. 4 is a schematic view showing speed components of the sheet fed through the registration portion 5A. Parts (a) and (b) of FIG. 5 are schematic views each illustrating a relative position between the reference member 31 and the sheet fed through the registration portion 5A. The conventional registration portion 5A does not include the constitution in which the roller constituting the feeding portion 50 is moved in the widthwise direction perpendicular to the sheet feeding direction. For that reason, the sheet is laterally shifted toward the reference member 31 by the obliquely feeding rollers 32 and then is fed along the reference member 31, so that the oblique movement of the sheet has been corrected. Here, as shown in FIG. 4, a speed component of the sheet, with respect to the sheet feeding direction, fed through the registration portion 5A is a speed V1, and a speed component of the sheet with respect to the widthwise direction perpendicular to the sheet feeding direction is a speed V2. Further, in each of parts (a) and (b) of FIG. 5, a distance between the end portion of the sheet S, fed through the registration portion 5A, with respect to the widthwise direction perpendicular to the sheet feeding direction is represented by a distance L.

Part (a) of FIG. 5 shows the case where with respect to the widthwise direction, the end portion of the sheet S is closer to the reference surface 301 of the reference member 31 than the obliquely feeding roller 32 is. Further, part (b) of FIG. 5 shows the case where with respect to the widthwise direction, the end portion of the sheet S is made distant from the reference surface 301 of the reference member 31 than the obliquely feeding roller 32 is. As shown in part (a) of FIG. 5, when the distance L is relatively small, with respect to the sheet feeding direction, the sheet abuts against the reference member 31 in the neighborhood of a central portion of the oblique movement correcting portion 55. On the other hand, as shown in part (b) of FIG. 5, when the distance L is relatively large, with respect to the sheet feeding direction, the sheet abuts against the reference member in the neighborhood of a left-hand end of the oblique movement correcting portion 55. That is, in the case where the distance L is relatively small, the sheet S starts to receive a friction resistance early from the reference member 31, so that a distance in which the sheet S receives the frictional resistance becomes long, with the result that the speed V1 becomes slow. On the other hand, in the case where the distance L is relatively large, abutment of the sheet S against the reference member 31 becomes late. By this, the distance in which the sheet S receives the frictional resistance from the reference member 31 becomes relatively short, so that the speed V1 becomes fast. Thus, when the oblique movement of the sheet is corrected by causing the sheet to abut against the reference member 31, a variation in distance L before the oblique movement correction occurs, and causes a change in feeding speed of the sheet during the oblique movement correction as shown in FIG. 6. FIG. 6 is a graph (plot) showing a relationship between the change in feeding speed of the sheet during the oblique movement correction and the distance L before the oblique movement correction. As shown in FIG. 6, a tendency that the speed V1 during the oblique movement correction becomes higher with a larger distance L is observed. Accordingly, it can be said that the variation in distance L before the oblique movement correction is one of causes of the variation in speed V1 during the oblique movement correction. The change in feeding speed of the sheet during the oblique movement correction is one of factors impairing productivity of printing.

Incidentally, the variation in distance L results from a manner of setting of the sheet by a user or a variation in feeding during the sheet feeding. On the other hand, in this embodiment, the sheet position detecting sensor 60 for detecting the position of the end portion of the sheet with respect to the widthwise direction of the sheet and the sliding mechanism 600 for moving the roller constituting the feeding portion 50 in the widthwise direction are provided. Then, the side end position of the sheet before the oblique movement correction is detected by the sheet position detecting sensor 60 and the roller constituting the feeding portion 50 is moved, so that the variation in distance L is corrected and thus the oblique movement correction of the sheet is made.

<Constitution of Feeding Portion>

The constitution of the feeding portion 50 will be specifically described using parts (a) and (b) of FIG. 7 and FIG. 8. Parts (a) and (b) of FIG. 7 are schematic views showing a cross-sectional structure of the feeding portion 50. FIG. 8 is a perspective view showing a drive constitution of the respective feeding rollers 34.

Each of the feeding rollers 34-1, 34-2, and 34-3 is constituted by a driving roller 13 to which a driving force is inputted and a follower roller 14 rotated by the driving roller 13 (parts (a) and (b) of FIG. 7). The feeding roller 34 is capable of being switched between a pressed state (part (a) of FIG. 7) in which the sheet is capable of being nipped in the nip and a spaced state (part (b) of FIG. 7) in which the nip is released. Incidentally, whether or not all the feeding rollers 34 are made switchable between the pressed state and the spaced state can be determined depending on a maximum size of the sheet capable of being fed by the printer 1.

The feeding portion 50 is provided with a cam mechanism 100 including an eccentric roller 103 as a first switching means capable of switching the state of each of the feeding rollers 34-1, 34-2, and 34-3 between the pressed state and the spaced state. The eccentric roller 103 is rotationally driven through gears 105 and 106 by a feeding driving motor Md as a driving source and swings an arm member 101 contacting a cam surface of an outer peripheral portion thereof. The arm member 101 is supported swingably about a swing shaft 102 relative to a stay member 18 and the arm member 101 contacts the eccentric roller 103 on one end side of the swing shaft 102 and supports a follower shaft 20 which is a rotation shaft of the follower roller 14 on the other side thereof. By the swing of the arm member 101, the follower roller 14 appears in and disappears from the sheet feeding passage. Accordingly, by controlling an angle of rotation of the eccentric roller 103 through the feeding roller driving motor Md which is a stepping motor, whereby a positional relationship between the follower roller 14 and the driving roller 13 can be switched. That is, by controlling the angle of rotation of the eccentric roller 103, it is possible to switch the state of each of the feeding rollers 34 between the spaced state in which the follower roller 14 is spaced from the driving roller 13 and the pressed state in which the follower roller 14 press-contacts the driving roller 13.

As shown in FIG. 8, the detecting roller 13 is a rubber roller provided on a driving roller shaft 301A and is connected to the feeding roller driving motor Md which is a driving source through a belt driving mechanism 302. The feeding roller driving motor Md is a stepping motor and is constituted so as to be capable of changing timings of a start and a stop of the drive and a driving speed (peripheral speed) of the driving roller 13.

<Constitution of Oblique Movement Correcting Portion>

Then, a constitution of the oblique movement correcting portion 55 will be specifically described using FIGS. 9 to 11. Part (a) of FIG. 9 is schematic view of the oblique movement correcting portion 55 as seen from above, and part (b) of FIG. 9 is a schematic view showing a cross-sectional structure of the reference member 31 as viewed in the sheet feeding direction V shown in part (a) of FIG. 9. Part (a) of FIG. 10 is a perspective view showing a pressing constitution of a pressing mechanism 33, and part (b) of FIG. 10 is a side view of the pressing mechanism 33. Parts (a) and (b) of FIG. 11 are schematic views showing a pressed state and a pressure-released state, respectively, by the pressing mechanism 33.

As shown in part (a) of FIG. 9, rotational axes of the obliquely feeding rollers 32-1, 32-2, and 32-3 are fixed by universal joints 321, 321, and 321, respectively, in a state in which each of the rotational axis is inclined in conformity to an angle α. Each of the obliquely feeding rollers 32 is connected to a correcting roller driving motor Ms which is a driving source through a driving mechanism including the universal joint 321, a belt 323, and pulley. The correcting roller driving motor Ms is a stepping motor and is capable of controlling a feeding speed and timings of a start and a stop of the drive.

As shown in part (b) of FIG. 9, the reference member 31 has a recessed-shaped cross-section including the reference surface 301 against which the side end of the sheet S abuts, an upper opposing surface capable of facing an upper surface of the sheet S, and a lower opposing surface capable of facing a lower surface of the sheet S. As a material of the reference member 31, a material which is constituted by an aluminum die-casting of which reference surface 301 is subjected to cutting to improve accuracy and which is coated with a fluorine-containing resin material, such as PTFE (polytetrafuloroethylene), subjected to electroless plating with nickel can be suitably used. By doing so, the reference surface 301 which is high in planarity and sliding property (low in frictional resistance against the sheet) is obtained, so that improvement in accuracy of the oblique movement correction of the sheet S can be realized.

In the oblique movement correcting portion 55, as shown in FIGS. 10 and 11, the pressing mechanism 33 which is a third switching means capable of switching between a pressed state in which the sheet is capable of being fed while being nipped in a nip (nip portion) between an obliquely feeding roller 32-*n* and a follower roller 331-*n* opposing the obliquely feeding roller 32-*n* and a (pressure)-released state in which the pressed state is released. Incidentally, the released state is not limited to a state in which the nip is released but also includes the case where the rollers contact each other with a force weaker than the force in the pressed state. Further, the pressed state of the pressing mechanism 33 refers to that at least one of the obliquely feeding rollers 32 is in the pressed state, and the released state of the pressing mechanism 33 refers to that all the obliquely feeding rollers 32 and in the released state. Further, in this embodiment, "n" is a numeral numbered from an upstream obliquely feeding roller 32 or an upstream follower roller 331 with respect to the sheet feeding direction V, and for example, the obliquely feeding roller 32-1 means the obliquely feeding roller 32 disposed on a most upstream side (n=1). That is, in the oblique movement correcting portion 55 in this embodiment, a plurality of pairs of the follower rollers **331-*n* and the pressing mechanisms 33 in a state in which the obliquely feeding roller 32-*n* shown in FIGS. 10 and 11 is replaced with either one of the obliquely feeding rollers 32-1, 32-2, and 32-3** are disposed.

As shown in parts (a) and (b) of FIG. 10, the pressing mechanism 33 includes an arm member 332, a link member 333, a pressing gear 334, a pressing spring 335, and a follower roller pressing motor Mk-n. The follower roller **331-*n* is rotatably supported about a follower (driven) shaft by the arm member 332 and is movable in a direction in which the follower roller 331 approaches the obliquely feeding roller 32-*n* or is separated from the obliquely feeding roller 32-*n* by swing of the arm member 332. The follower roller 331-*n* in this embodiment is rotated along the sheet feeding direction V about an axis extending in the widthwise direction, but a constitution in which the follower roller 331-*n* is disposed on an axis parallel to its corresponding obliquely feeding roller 32-*n* may also be employed. The arm member 332 is connected to the pressing gear 334 through the pressing spring 335 and the link member 333. The pressing gear 334** is connected to an output shaft of the follower roller pressing motor Mk-n which is a driving source.

As shown in part (a) of FIG. 11, in the pressed state, when the pressing gear 334 is rotated in the counterclockwise direction in the figure, the arm member 332 pulled by the pressing spring 335 is swung about a swing shaft **332*a* in the counterclockwise direction. By this, a press-contact state in which the follower roller 331-*n* is press-contacted to the obliquely feeding roller 32-*n* is formed. On the other hand, as shown in part (b) of FIG. 11, in the released state, when the pressing gear 334 is rotated in the clockwise direction in the figure and presses the link member 333, the link member 333 swings the arm member 332 in the clockwise direction. By this, the follower roller 331-*n* is separated from the obliquely feeding roller 32-*n*, or at least a spaced state in which a contact pressure of the follower roller 331-*n* to the obliquely feeding roller 32-*n*** is smaller than a contact pressure in the pressed state is formed.

The follower roller pressing motor Mk-n is a stepping motor, and by controlling an angle of rotation of the pressing gear 334, an elongation amount of the pressing spring 335 in the pressed state is capable of being changed. That is, the pressing mechanism 33 in this embodiment is capable of carrying out both switching between the pressed state and the released state and a change in pressure in the pressed state.

<Constitution of Sheet Position Detecting Sensor>

Next, with reference to FIG. 12, a constitution of the sheet position detecting sensor 60 as a detecting means in this embodiment will be described. FIG. 12 is a perspective view showing a locating position of the sheet position detecting sensor 60 in the feeding portion 50. The sheet position detecting sensor 60 is provided with an optical element such as a CIS (contact image sensor), and is disposed on the same side as the reference member 31 with respect to a center of the sheet with respect to the widthwise direction perpendicular to the sheet feeding direction V and at a biased position with respect to the widthwise direction. This is because the position of the side end of the sheet on a side where the sheet abuts against the reference member 31, and the influence of a fluctuation in cutting of the sheet with respect to the widthwise direction can be reduced. That is, in this embodiment, the distance L before the oblique movement correction can be detected with high accuracy.

<Slide Constitution of Feeding Roller>

Next, a drive constitution of the feeding roller 34-4 in this embodiment and a constitution of the sliding mechanism 600 as a first feeding roller moving portion for sliding the feeding roller 34-4 will be described with reference to FIGS. 13 to 15. FIG. 13 is a schematic perspective view of a roller driving mechanism 800 for driving the feeding roller 34-4. FIG. 14 is a schematic perspective view of the sliding mechanism 600 for sliding the feeding roller 34-4. Part (a) of FIG. 15 is an enlarged perspective view of a pressure-releasing mechanism 700 for putting the feeding roller 34-4 in the pressed state or in the spaced state, and part (b) of FIG. 15 is a sectional view of the pressure-releasing mechanism 700.

The feeding roller 34-4 is rotationally driven by the roller driving mechanism 800, and is constituted so as to be movable in the widthwise direction perpendicular to the sheet feeding direction by the sliding mechanism 600 in a state in which the sheet is nipped. Further, the feeding roller 34-4 is constituted so as to be capable of switching between the pressed state in which the sheet is nipped between rollers constituting the feeding roller 34-4 and the spaced state in which the rollers are spaced from each other. Incidentally, the released state of the feeding roller 34-4 is not limited to the state in which the nip is released but includes the case where the rollers contact each other with a force weaker than the force in the pressed state. The feeding roller 34-4 is constituted by an upper roller 401 and a lower roller 402 (see FIG. 15). The lower roller 402 is rotatably supported by a frame 201 (see FIG. 15), and the upper roller 401 is rotatably supported by a pressing arm 405 (see FIG. 14). The pressing arm 405 is rotatably fixed by a shaft 201 formed on the frame 201 (see FIG. 14). The upper roller 401 is pressed against the lower roller 402 by a tension spring 407. Further, to one end portion of the lower roller 402, a roller gear 412 for transmitting drive from the roller driving mechanism 800 to the lower roller 402 is fixed (see FIG. 13).

The roller driving mechanism 800 for rotating the feeding roller 34-4 is constituted by including a sliding roller driving motor 801, driving gears 802 and 803, and the roller gear 412 as shown in FIG. 13. The sliding roller driving motor 801 is fixed to the frame 201, and drive of the sliding roller driving motor 801 is transmitted to the roller gear 412 through the driving gears 802 and 803. Further, as regards the driving gear 803, a touch surface thereof is formed in a length d longer than a reciprocation width of the roller gear 412 so that engagement between itself and the roller gear 412 is maintained. The driving gears 802 and 803 are fixed to fixed shafts **201*b* and 201*c*, respectively, of the frame 201 so as to be rotatable freely. The sliding roller driving motor 801 rotates in the arrow A1 direction in FIG. 13. As the sliding roller driving motor 801, a stepping motor is used. By such a constitution, drive of the sliding roller driving motor 801 is transmitted to the roller gear 412, so that the feeding roller 34-4** is rotated.

The sliding mechanism 600 which is a moving means for moving the feeding roller 34-4 in the widthwise direction perpendicular to the sheet feeding direction includes, as shown in FIG. 14, a slide motor 601 secured to a motor supporting plate 603 with screws in a state in which the slide motor 601 is fixed to a motor table 602. Above the motor supporting table 603 through the slide motor 601, a pulley supporting plate 604 is secured with screws. To the pulley supporting plate 604, pulley tables 605 and 606 are fixed. To the pulley tables 605 and 606, pulley shafts 607 and 608 are rotatably fixed, respectively. To the pulley shaft 607, pulleys 609 and 610 are fixed, and to the pulley shaft 608, a pulley 611 is fixed (see FIG. 13). Further, to a free end of an output shaft of the slide motor 601, a pulley 612 is fixed. Between the pulleys 609 and 612, a timing belt 613 is stretched, and between the pulleys 610 and 611, a timing belt 614 is stretched.

At an end portion of the lower roller on the roller gear 412 side, a holder 415 is rotatably supported by a bearing. On the holder 415, a sensor flag 416 for detecting home positions of the upper roller 401 and the lower roller 402 of the feeding roller 34-4 with respect to the widthwise direction is mounted. When the upper roller 401 and the lower roller 402 of the feeding roller 34-4 are in the home positions, the sensor flag 416 is detected by a sensor 615 provided on the pulley supporting plate 604. Further, the holder 415 is fixed to the timing belt 614 by a stopper 616 and screws. By such a constitution, the timing belt 614 is rotated by drive of the slide motor 601, and with rotation of the timing belt 614, the lower roller 402 of the feeding roller 34-4 is reciprocated in the widthwise direction perpendicular to the sheet feeding direction. Further, the upper roller 401 of the feeding roller 34-4 is engaged with the lower roller 402 by an engaging member, and is reciprocated together with the lower roller 402 in the widthwise direction perpendicular to the sheet feeding direction. In this embodiment, before the leading end of the sheet reaches the feeding roller 34-4, the position of the sheet end portion with respect to the widthwise direction detected by the CIS 60 is detected. Then, on the bases of a detection result thereof, the slide motor 601 is driven, so that the feeding roller 34-4 is moved in the widthwise direction.

The pressure releasing mechanism 700 which is a second switching means for moving the upper roller 401 and the lower roller 402 of the feeding roller 34-4 toward and away from each other includes, as shown in part (a) of FIG. 15, a pressure-releasing shaft 701 positioned to the frame 201. Further, the pressure-releasing mechanism 700 is constituted by including cams 702 and 703 (see part (b) of FIG. 15) fixed to the pressure-releasing shaft 701. Into the cams 702 and 703, as shown in part (b) of FIG. 15, deep groove ball bearings 702*a* and 703*a* are press-fitted at positions eccentric from centers of rotation of the cams 702 and 703, respectively. Further, as shown in part (a) of FIG. 15, the cam 702 is provided with a gear 702*b*, and drive of the pressure-releasing motor 704 is transmitted through the cam 702, so that a pressure-releasing shaft 70 is rotated.

Further, the deep groove ball bearing 702*a* is disposed at a position where the deep groove ball bearing 702*a* is contactable to the pressing arm 405, and when the pressure-releasing shaft 701 is rotated one full turn, the deep groove ball bearing 702*a* switches the pressing arm 405 against an urging force of a spring 407. Thus, the pressing arm 405 is swung, so that the upper roller 401 and the lower roller 402 can be contacted to and spaced from each other once. Incidentally, a pressing arm is also provided on a side where the deep groove ball bearing 703*a* is provided with respect to a shaft direction of the pressure-releasing shaft 701. Further, the cam 703 is provided with a sensor flag 703*b* (see part (b) of FIG. 15). A phase of the pressure-releasing shaft 701 is determined by detecting the sensor flag 703*b* by a sensor 706 fixed to a sensor supporting plate 705 fixed on the frame 201, so that rotation of the pressure-releasing motor 704 is controlled depending on the phase of the pressure-releasing shaft 701. Further, phases of the cams 702 and 703 are determined so that the sensor flag 703*b* blocks the sensor 706 when the upper roller 401 and the lower roller 402 of the feeding roller contact each other.

<Control Constitution of Registration Portion>

Next, a control constitution of the registration portion 5 will be described with reference to FIG. 16. As shown in FIG. 16, an operation of the registration portion 5 is controlled by a controller 600A mounted in the printer 1. The controller 600A which is an example of a control means in this embodiment includes a CPU 601 as an arithmetic (computing) means, a RAM 602 and a ROM 603 which are storing means, and an interface (I/O) 604 for an external device or network.

The CPU 601 carries out control on the bases of information inputted through an operating portion 400 as a user interface or detection signals from the pre-registration sensor P and the before-registration sensor Q which are described above. The detection signals from the pre-registration sensor P and the before-registration sensor Q are inputted to the CPU 601 through AD conversion portions 605P and 605Q, respectively. Further, a detection signal from the sheet position detecting sensor 60 is inputted to the CPU 601 through an AD conversion portion 60C. The CPU 601 loads and executes a program stored in the ROM 603 or the like. The CPU 601 drive-controls motors (Ms, 801, 701, Md, 104*d*, Mk-n, 901, and the like) which are actuators of the registration portion 5, through drivers 606*d*, 607*a*, 607*b*, 607*c*, 608*a*, 608*b*, and 609-*n*. By this, steps of a control method described along a flowchart of FIG. 17 are capable of being executed. Incidentally, the follower rollers 331-*n* are disposed in number (n) corresponding to the obliquely feeding rollers 32-*n*, and the CPU 601 is capable of independently controlling presence or absence of pressing of and a magnitude of a pressing force of the follower rollers 331-*n* against the obliquely feeding rollers 32, respectively.

<Control Method of Registration Portion>

Next, a sheet feeding operation in the registration portion 5 in the embodiment 1 will be described along the flowchart of FIG. 17. Further, during execution of the flowchart of FIG. 17, the obliquely feeding rollers are continuously driven rotationally. Incidentally, as described above, control of the sheet feeding operation in the registration portion 5 in this embodiment is realized by executing the program stored in the storing means such as the ROM 603 after the program is developed in the RAM 602. Accordingly, the steps included in the flowchart of FIG. 17 are executed by respective portions of the registration portion 5 in accordance with control of the CPU 601. Further, in the flowchart of FIG. 17, the feeding roller 34-4 is referred to as a "sliding roller" as a first feeding roller and description will be made.

First, an image forming job is started in a state in which profile information which is information indicating a characteristic of the sheet S which is an object of image formation and pieces of information on a size, a number of sheets, and the like of the sheet S are inputted through the operating portion 400 or the interface I/O 604 (S01). Here, the profile information of the sheet S acquired by the CPU 601 through the operating portion 400 or the interface I/O 604 is information indicating the characteristic of the sheet S, such as a basis weight, rigidity, surface roughness, a material, or the like, for example. Then, on the bases of the information inputted in S01, pressure (pressing force) of each of the obliquely feeding rollers 32 is determined (S02).

However, the pressure in this embodiment is a pressing force of the follower roller 331-*n* against the obliquely feeding roller 32-*n* and is a value determined for each of the obliquely feeding rollers 32-1, 32-2, and 32-3 on the bases of the information stored in advance in the ROM 603 or the like. A magnitude of the pressure is, for example, a value set depending on the basis weight of the sheet S in this embodiment so that the sheet S is capable of being fed stably irrespective of a kind of the sheet S. On the basis of the thus-determined pressure, pressing of each of the obliquely feeding rollers 32 is started, so that the obliquely feeding rollers 32 are in the pressed state (S03).

Thereafter, when the image forming operation by the image forming portions PY to PK is started (S04), on the bases of a start timing of the image forming operation, a delay time of a feeding start of the sheet S is counted (S05), and thereafter, the sheet S is fed from the feeding cassette 51 (S06). In a process until the sheet S fed from the feeding cassette 51, the position of the end portion of the sheet S with respect to the widthwise direction perpendicular to the sheet feeding direction is detected by the sheet position detecting sensor 60 (S07). Then, on the bases of the position of the end portion of the sheet S detected in S07, the CPU 601 determines the position of the end portion of the reference member S relative to the reference surface 301 of the reference member 31.

Here, relative to the reference surface 301 of the reference member 31 with respect to the widthwise direction, the case where the end portion of the sheet S is closer than the obliquely feeding roller 32 is (see part (a) of FIG. 5) and the case where the end portion of the sheet S is more distant than the obliquely feeding roller 32 is (see part (b) of FIG. 5) will be considered. In the case where the sheet S is in the positional relationship shown in part (a) of FIG. 5, the sheet S abuts against the reference surface 301 at a position between the obliquely feeding rollers 32-1 and 32-2. On the other hand, in order to cause the sheet S to abut against the reference surface 301 in the case where the sheet S is in the positional relationship shown in part (b) of FIG. 5, there is a need to feed the sheet S by the obliquely feeding rollers 32 over a length longer than the length in the case where the sheet S in the positional relationship shown in part (a) of FIG. 5. Accordingly, with respect to the widthwise direction, the position of the end portion of the sheet S relative to the reference surface 301 of the reference member 31 fluctuates, so that a feeding speed of the sheet S when the sheet S is fed along the reference surface 301 also fluctuates (see FIG. 15).

On the other hand, in this embodiment, before the leading end of the sheet S reaches the obliquely feeding roller 32, the sheet S is moved in the widthwise direction depending on the position of the end portion of the sheet S relative to the reference surface 301 of the reference member 31 with respect to the widthwise direction. For that purpose, depending on the position of the end portion of the sheet S relative to the reference surface 301 of the reference 31, a movement distance of the sliding roller (feeding roller 34-4) with respect to the widthwise direction is determined (S08). For example, in the case where the position of the end portion of the sheet S relative to the reference surface 301 of the reference member 31 with respect to the widthwise direction is the position shown in part (a) of FIG. 5, the movement distance (12 mm) of the sliding roller with respect to the widthwise direction is determined so that the distance between the end portion of the sheet S and the reference surface 301 with respect to the widthwise direction is 4 mm. On the other hand, in the case where the end portion position of the sheet S relative to the reference surface 301 of the reference member 31 with respect to the widthwise direction is the position shown in part (b) of FIG. 5, the movement D (42 mm) of the sliding roller with respect to the widthwise direction is determined so that the distance between the end portion of the sheet S and the reference surface 301 with respect to the widthwise direction is 4 mm. Thus, in the case where the end portion position of the sheet S relative to the reference surface 301 of the reference member 31 with respect to the widthwise direction is a first position (for example, part (a) of FIG. 5), the sliding roller is moved in the widthwise direction by a first distance. On the other hand, in the case where the end portion position of the sheet S relative to the reference surface 301 is a second position more distant from the reference surface 301 than the first position is (for example, part (b) of FIG. 5), the sliding roller is moved in the widthwise direction by a second distance longer than the first distance. Thus, in this embodiment, variation in end portion position of the sheet S relative to the reference surface 301 of the reference member 31 with respect to the widthwise direction is reduced. Specifically, a position where the end portion of the sheet S abuts against the reference surface 301 is positioned between the second obliquely feeding roller 32-2 and the third obliquely feeding roller 32-3 with respect to the sheet feeding direction. Further, a target value of the distance between the reference surface 301 and the end portion of the sheet S was 4 mm in the above case, but it is turned out by an experiment that the distance is set optimally in a range from 4 mm to 10 mm when a degree of the oblique movement of the sheet S fed in the sheet feeding direction is taken into consideration.

Then, when the sheet S delivered to the sliding roller is detected by the pre-registration sensor P (S09/Y), a stop delay time is counted (S10). When the stop delay time has elapsed. The drive of feeding roller driving motor Md and the drive of the sliding roller driving motor 801 are stopped (S11). By the stop of the drive of the feeding roller driving motor Md and the drive of the sliding roller driving motor 801 are stopped, whereby the feeding of the sheet S is stopped in a state in which the sheet S is nipped by the sliding rollers. Incidentally, in S09, in the case where the pre-registration sensor P does not detect the sheet S even when a predetermined time has elapsed from the start of the feeding of the sheet S (S09/N), a screen showing a sheet jam is displayed on the operating portion 400 (S24), and then the job ends.

Further, in S11, the drive of the feeding roller driving motor Md and the drive of the sliding roller driving motor 801 are stopped, and thereafter, the nip ping of the sheet S by the feeding rollers 34-3, 34-2, and 34-1 which are third feeding rollers positioned upstream of the sliding roller is released (S12). Then, the sliding roller is moved in the widthwise direction depending on the movement distance of the sliding roller with respect to the widthwise direction determined in S08 (S13). When the sliding roller is moved in the widthwise direction, the nipping of the sheet S by the feeding rollers 34-3, 34-2, and 34-1 is released, and therefore, a load on the sheet S due to slide movement can be reduced.

Thereafter, a re-start delay time is counted in conformity to progression of the image forming operation (step S14), and then the drive of the sliding roller driving motor 801 is resumed (step S15). A re-drive timing of the sliding roller driving motor 801 is adjusted in conformity to the image forming operation, so that a variation in time until the sheet S reaches the pre-registration sensor P is absorbed. Thereafter, a delay time for releasing the pressed state of the sliding roller is counted (step S16), and the upper roller 401 and the lower roller 402 are spaced from each other, so that the sliding roller is in the spaced state (step S17). By this, the nipped state of the sheet S by the sliding roller is released, so that an abutment aligning operation for correcting the oblique movement of the sheet S by causing the sheet S to abut against the reference member 31 is started.

When the pressed state of the sliding roller is released, the sheet S starts oblique movement relative to the sheet feeding direction so as to approach the reference member 31 by a feeding force received from the obliquely feeding rollers 32. That is, the sheet S is (obliquely) fed along a tangential direction of each of the obliquely feeding rollers 32 inclined relative to the sheet feeding direction and thus is shifted toward the reference surface 301 of the reference member 31. After the start of the press of the sheet S by the obliquely feeding rollers 32 in S03, when the before-registration sensor Q detects the leading end of the sheet S (S18/Y), a delay time for releasing the pressed state of the obliquely feeding rollers is counted (S19). Then, after the delay time in S19 has elapsed, the pressed state of the obliquely feeding rollers 32 is released (S20). This delay time is set so that the obliquely feeding rollers 32 are put in the pressed state after the leading end of the sheet S enters the nip of the registration roller pair 7. Incidentally, in the case where the before-registration sensor Q does not detect the sheet S in a predetermined time, the screen showing the sheet jam is displayed at the operating portion 400 (step S24), and then the job ends.

When the sheet S is delivered to the registration roller pair 7 in this embodiment, the registration roller pair 7 moves in the widthwise direction while feeding the sheet S. By this, a center position of the sheet S with respect to the widthwise direction perpendicular to the sheet feeding direction is positionally aligned in conformity to a center position of the images formed by the image forming portions PY to PK. When the sheet S is sent to the secondary transfer portion T, by a counter for managing the number K of remaining sheets S to be subjected to image formation, a value of the number K is decremented (step S22). In the case where the number K of remaining sheets S is not 0, i.e., in the case where the sheets to be subjected to image formation remain (step S23/N), the above-described operation (steps S03 to S23) is repeated. In the case where the number K of remaining sheets S is 0 (step S23/Y) discrimination that the image forming operation is completed is made, so that the job ends.

Thus, in this embodiment, before the leading end of the sheet S reaches the obliquely feeding roller 32, the sheet S is moved in the widthwise direction depending on the end portion position of the sheet S relative to the reference surface 301 of the reference member 31 with respect to the widthwise direction. By this, the variation in end portion position of the sheet S relative to the reference surface 301 of the reference member 31 with respect to the widthwise direction can be reduced. As a result, a variation in feeding time until the obliquely feeding rollers obliquely feeds the sheet S and the leading end of the sheet S reaches the registration roller pair can be reduced, and therefore, it becomes possible to improve productivity of the sheet feeding device (image forming apparatus).

Embodiment 2

<Constitution of Registration Portion>

In the embodiment 1, the constitution in which the feeding roller 34-4 disposed on the most downstream side of the feeding portion 50 with respect to the sheet feeding direction was provided with the sliding mechanism 600 was described. In this embodiment, a constitution in which downstream feeding rollers 34-4 and 34-3 of the feeding portion 50 with respect to the sheet feeding direction are provided with sliding mechanisms 600*a* and 600*b*, respectively, will be described. FIG. 18 is a schematic sectional view of a registration portion 5 in this embodiment. The registration portion 5 in this embodiment has the same constitution as the registration portion 5 in the embodiment 1 except that the feeding roller 34-3 is provided with the sliding mechanism 600*b*. Further, constitutions of the sliding mechanism 600*a* as a first feeding roller moving portion and the sliding mechanism 600*b* as a second feeding roller moving portion are the same as the constitution of the sliding mechanism 600 in the embodiment 1, and therefore, will be omitted from redundant description. Incidentally, all the feeding rollers 34 constituting the feeding portion 50 may also be provided with sliding mechanisms 600.

<Control Constitution of Registration Portion>

Next, a control constitution of the registration portion 5 in this embodiment will be described with reference to FIG. 19. As shown in FIG. 19, an operation of the registration portion 5 is controlled by a controller 600A mounted in the printer 1. Incidentally, also, in the control constitution of the registration portion 5 in this embodiment, constituent elements which are the same as those in the embodiment 1 are represented by the same reference numerals or symbols and will be omitted from redundant description. The CPU 601 drive-controls motors (Ms, 801*a*, 801*b*, 701*a*, 701*b*, Md, 104*d*, Mk-n, 901*a*, 901*b*, and the like) which are actuators of the registration portion 5, through drivers 606*d*, 607*a*, 607*b*, 607*c*, 608*a*, 608*b*, and 609-*n*. By this, steps of a control method described along a flowchart of FIG. 20 are capable of being executed.

<Control Method of Registration Portion>

Next, a sheet feeding operation in the registration portion 5 in the embodiment 2 will be described along the flowchart of FIG. 20. Further, during execution of the flowchart of FIG. 20, the obliquely feeding rollers are continuously driven rotationally. Incidentally, as described above, control of the sheet feeding operation in the registration portion 5 in this embodiment is realized by executing the program stored in the storing means such as the ROM 603 after the program is developed in the RAM 602. Accordingly, the steps included in the flowchart of FIG. 20 are executed by respective portions of the registration portion 5 in accordance with control of the CPU 601. Further, in the flowchart of FIG. 20, the feeding roller 34-4 is referred to as a "first sliding roller" and the feeding roller 34-3 is referred to as a "second sliding roller", and description will be made. In this embodiment, a first feeding roller is the feeding roller 34-4, and a third feeding roller is the feeding roller 34-3. Incidentally, in the flowchart of FIG. 20, steps identical to the steps in the sheet feeding operation in the registration portion 5 in the embodiment 1 are represented by the same reference numerals or symbols in FIG. 17 and will be omitted from redundant description.

In the flowchart of FIG. 20, the steps until S09 are identical to those in the embodiment 1. In this embodiment, description will be made from a step S101. When the sheet S delivered to the sliding roller is detected by the pre-registration sensor P (S09/Y), a stop delay time is counted (S101). When the stop delay time has elapsed. The drive of feeding roller driving motor Md and the drive of the sliding roller driving motors 801 and 801*b* are stopped (S111). By the stop of the drive of the feeding roller driving motor Md and the drive of the sliding roller driving motors 801*a* and 801*b* are stopped, whereby the feeding of the sheet S is stopped in a state in which the sheet S is nipped by the first and second sliding rollers. Incidentally, in S09, in the case where the pre-registration sensor P does not detect the sheet S even when a predetermined time has elapsed from the start of the feeding of the sheet S (S09/N), a screen showing a sheet jam is displayed on the operating portion 400 (S24), and then the job ends.

Further, in S111, the drive of the feeding roller driving motor Md and the drive of the sliding roller driving motors 801*a* and 801*b* are stopped, and thereafter, the nip ping of the sheet S by the feeding rollers 34-2 and 34-1 which are third feeding rollers positioned upstream of the sliding roller is released (S121). Then, the first sliding roller and the second sliding roller are moved in the widthwise direction depending on the movement distance of the sliding roller with respect to the widthwise direction determined in S08 (S131). When the sliding roller is moved in the widthwise direction, the nipping of the sheet S by the feeding rollers 34-2 and 34-1 is released, and therefore, a load on the sheet S due to slide movement can be reduced.

Thereafter, a re-start delay time is counted in conformity to progression of the image forming operation (step S141), and then the drive of the sliding roller driving motors 801*a* and 801*b* are resumed (step S151). A re-drive timing of the sliding roller driving motors 801*a* and 801*b* are adjusted in conformity to the image forming operation, so that a variation in time until the sheet S reaches the pre-registration sensor P is absorbed. Thereafter, a delay time for releasing the pressed state of each of the first and second sliding rollers is counted (step S16), and the upper roller 401 and the lower roller 402 are spaced from each other, so that the first and second sliding rollers are in the spaced state (step S171). By this, the nipped state of the sheet S by the first and second sliding rollers are released, so that an abutment aligning operation for correcting the oblique movement of the sheet S by causing the sheet S to abut against the reference member 31 is started.

When the pressed state of the first and second sliding rollers is released, the sheet S starts oblique movement relative to the sheet feeding direction so as to approach the reference member 31 by a feeding force received from the obliquely feeding rollers 32. That is, the sheet S is (obliquely) fed along a tangential direction of each of the obliquely feeding rollers 32 inclined relative to the sheet feeding direction and thus is shifted toward the reference surface 301 of the reference member 31. Subsequent steps are similar to those in the embodiment 1, and therefore, will be omitted from description.

Also, in this embodiment, similarly as in the embodiment 1 before the leading end of the sheet S reaches the obliquely feeding roller 32, the sheet S is moved in the widthwise direction depending on the end portion position of the sheet S relative to the reference surface 301 of the reference member 31 with respect to the widthwise direction. By this, the variation in end portion position of the sheet S relative to the reference surface 301 of the reference member 31 with respect to the widthwise direction can be reduced. As a result, a variation in feeding time until the obliquely feeding rollers obliquely feeds the sheet S and the leading end of the sheet S reaches the registration roller pair can be reduced, and therefore, it becomes possible to improve productivity of the sheet feeding device (image forming apparatus). Further, in this embodiment, the sheet S is moved in a state in which the sheet S is nipped by the feeding rollers 34-4 and 34-3, and therefore, even when a sheet having a smooth surface property and a sheet having a large basis weight are used, it is possible to quickly move the sheet S in the widthwise direction.

Embodiment 3

In the embodiments 1 and 2, when the sheet S is moved in the widthwise direction, of the rollers of the feeding portion 50, the rollers other than the rollers for moving the sheet S in the widthwise direction while nipping the sheet S are spaced. In recent years, the printer 1 has been desired to meet a sheet (elongated sheet) extremely long in sheet length with respect to the sheet feeding direction. However, when a constitution in which the rollers other than the rollers for moving the sheet S in the widthwise direction while nipping the sheet S are spaced is employed during movement of the elongated sheet in the widthwise direction, the structure of the printer 1 is complicated and is liable to cause increases in size and cost of the sheet feeding device. Therefore, in this embodiment, in the case where the sheet fed through the registration portion 5 is the elongated sheet, a variation in distance L before the oblique movement correction (see FIG. 4) is suppressed by moving the reference member 31 in the widthwise direction.

As shown in FIG. 21, in the oblique movement correction of the sheet with a normal length described in the embodiments 1 and 2, from the viewpoint of high productivity, there is a need to feed a plurality of sheets (a sheet S1, a sheet S2, . . . ) in contact with the reference member at the same time. For that reason, in the case where the elongated sheet is fed, even when the reference member 31 is intended to be moved on the bases of a detection result of a position of a side end of the elongated sheet, the reference member 31 cannot be slid due to the presence of the sheet S1 fed ahead. On the other hand, in this embodiment, depending on the length of the sheet, with respect to the sheet feeding direction, fed through the feeding portion 50, either one of movement of the feeding roller 34-4 and movement of the reference member 31 is executed.

FIG. 21 shows an example in which the feeding rollers 34-4 and 34-3 are provided with the sliding mechanisms 600 in the embodiment 1. Other than this example, a constitution in which only the feeding roller 34-4 is provided with the sliding mechanism 600 may also be employed. In FIGS. 23 and 24, assuming that the feeding roller 34-4 with the sliding mechanism 600, the feeding roller 34-4 is referred to as a "sliding roller" and description will be made. Even in the case where each of the feeding rollers 34-4 and 34-3 is provided with the sliding mechanism 600, the oblique movement correction can be made in accordance with steps of FIG. 24, and therefore, in this embodiment, the constitution in which the feeding roller 34-4 is provided with the sliding mechanism 600 will be described as an example. Incidentally, constitution except that a reference member moving mechanism 300 for moving the reference member 31 in the widthwise direction are the same as those in the embodiments 1 and 2, and therefore, will be omitted from redundant description.

<Constitution of reference member moving mechanism>

A constitution of the reference member moving mechanism 300 as a contact surface moving portion for moving the reference member 31 in the widthwise direction will be described with reference to parts (a) and (b) of FIG. 22. As shown in part (a) of FIG. 22, the reference member moving mechanism 300 is provided with bearing stands 303A and 303B fixed on a base portion 300A. These bearing stands 303A and 303B rotatably support a lead screw 304. As shown in part (b) of FIG. 22, double row angular ball bearings 315 are fitted into the bearing stand 303A. The angular ball bearings 315 are fixed to the lead screw 304 via two spacers 306 by a lock nut 307. Accordingly, when the lock nut 307 is fastened by a predetermined torque, by a backlash reducing effect of the angular ball bearings 315, the lead screw 304 is uniquely positioned relative to the bearing stand 303A. Inside the bearing stand 303B, deep groove ball bearings 308 are engaged with a predetermined interval. Further, the deep groove ball bearings 308 and the lead screw 304 are engaged with a predetermined interval, and a C-ring 309 is attached to a free end of the lead screw 304 so as to retain the deep groove ball bearings 308.

To a spline portion 304*a* of the lead screw 304, a nut 310 is rotatably attached, and to the nut 310, a bracket 311 to which the reference member 31 (see FIG. 21) is connectable is fixed. The lead screw 304 and the nut 310 are ball springs, and balls are incorporated into the nut 310. By this, improvement in accuracy and noise reduction during movement of the reference member 31 are realized. Further, to a free end portion 304*b* of the lead screw 304, a reference member slide motor 313 to connected via a coupling 312, so that a deviation in rotation center between the reference member slide motor 313 and the lead screw 304 is absorbed. The reference member slide motor 313 is fixed to a motor supporting plate 314. By the thus-constituted reference member moving mechanism 300, the reference member 31 is slidable in the widthwise direction.

<Control Constitution of Registration Portion>

Next, a control constitution of the registration portion 5 in this embodiment will be described with reference to FIG. 23. As shown in FIG. 23, an operation of the registration portion 5 is controlled by a controller 600A mounted in the printer 1. Incidentally, also, in the control constitution of the registration portion 5 in this embodiment, constituent elements which are the same as those in the embodiments 1 and 2 are represented by the same reference numerals or symbols and will be omitted from redundant description. The CPU 601 drive-controls motors (Ms, 801, 701, Md, 104*d*, Mk-n, 901, 313, and the like) which are actuators of the registration portion 5, through drivers 606*d*, 607*a*, 607*b*, 607*c*, 608*a*, 608*b*, 609-*n*, and 313*c*. By this, steps of a control method described along a flowchart of FIG. 24 are capable of being executed.

<Control Method of Registration Portion>

Next, a sheet feeding operation in the registration portion 5 in the embodiment 3 will be described along the flowchart of FIG. 24. Further, during execution of the flowchart of FIG. 24, the obliquely feeding rollers are continuously driven rotationally. Incidentally, as described above, control of the sheet feeding operation in the registration portion 5 in this embodiment is realized by executing the program stored in the storing means such as the ROM 603 after the program is developed in the RAM 602. Accordingly, the steps included in the flowchart of FIG. 24 are executed by respective portions of the registration portion 5 in accordance with control of the CPU 601. Further, in the flowchart of FIG. 24, the feeding roller 34-4 is referred to as a "sliding roller" and description will be made. Incidentally, in the flowchart of FIG. 24, steps identical to the steps in the sheet feeding operation in the registration portion 5 in the embodiments 1 and 2 are represented by the same reference numerals or symbols in FIGS. 17 and 20 and will be omitted from redundant description.

In the flowchart of FIG. 24, the steps until S11 are identical to those in the embodiment 1. In this embodiment, description will be made from a step S31. In S11, the drive of the feeding roller driving motor Md and the drive of the sliding roller driving motor 801 are stopped, on the bases of the information acquired in S01, the CPU 601 discriminates whether or not the length of the sheet with respect to the sheet feeding direction is 762 mm or less (S31). In the case where the sheet length with respect to the sheet feeding direction is 762 mm or less (S31/Y), the nipping of the sheet S by the feeding rollers 34-4, 34-2, and 34-1 as the third feeding rollers positioned upstream of the sliding roller is released (S32). Then, the sliding roller is moved in the widthwise direction depending on the movement distance of the sliding roller with respect to the widthwise direction determined in S08 (S33). When the sliding roller is moved in the widthwise direction, the nipping of the sheet S by the feeding rollers 34-3, 34-2, and 34-1 is released, and therefore, a load on the sheet S due to slide movement can be reduced.

Thereafter, a re-start delay time is counted in conformity to progression of the image forming operation (step S34), and then the drive of the sliding roller driving motor 801 is resumed (step S35). A re-drive timing of the sliding roller driving motor 801 is adjusted in conformity to the image forming operation, so that a variation in time until the sheet S reaches the pre-registration sensor P is absorbed. Thereafter, a delay time for releasing the pressed state of the sliding roller is counted (step S36), and the upper roller 401 and the lower roller 402 are spaced from each other, so that the sliding roller is in the spaced state (step S37). By this, the nipped state of the sheet S by the sliding roller is released, so that an abutment aligning operation for correcting the oblique movement of the sheet S by causing the sheet S to abut against the reference member 31 is started.

On the other hand, in the case where the sheet length with respect to the sheet feeding direction is longer than 762 mm (S31/N), the reference member 31 is moved in the widthwise direction by the same distance as the movement distance of the sliding roller with respect to the widthwise direction determined in S08 (S38). Thereafter, the sliding roller and the feeding roller 34 are put in the spaced state (S39), and thus the nipped state of the sheet S in the feeding portion 50 is released, and then an abutment adjusting operation for correcting the oblique movement of the sheet S by causing the sheet S to abut against the reference member 31. Subsequent steps are similar to those in the embodiments 1 and 2, and therefore, will be omitted from description.

In this embodiment, in the case where the end portion position of the sheet S relative to the reference surface 301 of the reference member 31 is the position shown in part (a) of FIG. 5, the movement distance (12 mm) of the sliding roller or the reference member 31 with respect to the widthwise direction is determined so that the distance from the end portion of the sheet S to the reference surface 301 with respect to the widthwise direction is 4 mm. On the other hand, in the case where the end portion position relative to the reference surface 301 of the reference member 31 is the position shown in part (b) of FIG. 5, the movement distance (42 mm) of the sliding roller or the reference member 31 with respect to the widthwise direction is determined so that the distance from the end portion of the sheet S to the reference surface 301 with respect to the widthwise direction is 4 mm. Thus, in the case where the end portion position of the sheet S relative to the reference surface 301 of the reference member 31 with respect to the widthwise direction is a third position (for example, the position of part (a) of FIG. 5), the reference member 31 is moved, in the widthwise direction by a third distance. On the other hand, in the case where the end portion position of the sheet S relative to the reference surface 301 of the reference member 31 with respect to the widthwise direction is a fourth position (for example, the position of part (b) of FIG. 5) remoter than the third position, the reference member 31 is moved in the widthwise direction by a fourth distance longer than the third distance. Further, in the case where the end portion position of the sheet S relative to the reference surface 301 of the reference member 31 with respect to the widthwise direction is a fifth position (for example, the position of part (a) of FIG. 5), the reference member 31 is moved, in the widthwise direction by a fifth distance. On the other hand, in the case where the end portion position of the sheet S relative to the reference surface 301 of the reference member 31 with respect to the widthwise direction is a sixth position (for example, the position of part (b) of FIG. 5) remoter than the fifth position, the sliding roller is moved in the widthwise direction by a sixth distance longer than the fifth distance. In this embodiment, a variation in end portion position of the sheet S relative to the reference surface 301 of the reference member 31 with respect to the widthwise direction is reduced in the above-described manner.

Thus, in this embodiment, in the case where the sheet length with respect to the sheet feeding direction is a second length (for example, 762 mm or less) shorter than a first length (for example, a length (first length)) of the registration portion 5 with respect to the sheet feeding direction), the feeding roller 34-4 is moved in the widthwise direction. On the other hand, in the case where the sheet length with respect to the sheet feeding direction is the first length, switching is made so that the reference member 31 is moved in the widthwise direction. Accordingly, even in the case where the elongated sheet is fed, there is no need to provide a constitution in which the rollers of the feeding portion 50 are spaced from each other over a full length of the sheet, so that complication of the structure of the printer 1 and upsizing of the printer 1 can be avoided.

OTHER EMBODIMENTS

In the embodiments 1 to 3, the constitution in which the registration portion 5 is provided upstream of the secondary transfer portion T of the printer 1 was described. Other than this constitution, for example, a constitution similar to the registration portion 5 may also be mounted in a post-printing apparatus in which the sheet is subjected to post-processing such as punching or stapling.

Further, the present invention is also capable of being realized in a process in which a program for realizing one or more functions in the above-described embodiments is supplied to a system or an apparatus through a network or a recording medium and then one or more processors in a computer of the system or the apparatus loads and executes the program. Further, the present invention is also capable of being realized by a circuit (for example, ASIC) realizing one or more functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-115861 filed on Jul. 3, 2020, which is hereby incorporated by reference herein in its entirety.

What is claimed is:

1. A sheet feeding device comprising:

a first feeding roller pair movable in a widthwise direction of a sheet perpendicular to a sheet feeding direction in a state in which the sheet is nipped and configured to feed the sheet without changing an angle formed by a direction along a side-edge portion of the sheet when the sheet reaches said first feeding roller pair-and a predetermined direction regardless of the angle;

a reference member provided downstream of said first feeding roller pair with respect to the sheet feeding direction, said reference member including a contact surface to which the side-edge portion of the sheet with respect to the widthwise direction of the sheet is contactable, the contact surface extending in the predetermined direction;

an obliquely feeding roller configured to obliquely feed the sheet by contacting the sheet in an inclination direction relative to the sheet feeding direction so that the sheet approaches the contact surface in the widthwise direction of the sheet with movement of the sheet toward a downstream side of the sheet feeding direction;

a detecting sensor provided upstream of said first feeding roller pair with respect to the sheet feeding direction and configured to detect the side-edge portion of the sheet with respect to the widthwise direction of the sheet; and a controller configured to control of movement of said first feeding roller pair in the widthwise direction of the sheet, wherein before the sheet is obliquely fed by said obliquely feeding roller, said controller causes said first feeding roller pair to move the sheet to a predetermined position in the widthwise direction of the sheet on the basis of a detection result of said detecting sensor.

2. A sheet feeding device according to claim 1, wherein detection of the sheet with respect to the widthwise direction by said detecting sensor is executed before a leading end of the sheet reaches said first feeding roller pair.

3. A sheet feeding device according to claim 1, wherein said obliquely feeding roller includes a first obliquely feeding roller, a second obliquely feeding roller, and a third obliquely feeding roller provided in a named order toward the downstream side of the sheet feeding direction at positions overlapping with the contact surface as viewed in the widthwise direction of the sheet, and wherein the sheet fed to the predetermined position by said first feeding roller pair abuts against the contact surface at a side end thereof after a leading end thereof reaches said second obliquely feeding roller with respect to the sheet feeding direction.

4. A sheet feeding device according to claim 1, further comprising:

a second feeding roller pair provided adjacent to and upstream of said first feeding roller pair with respect to the sheet feeding direction and configured to feed the sheet; and a first switching cam configured to switch said second feeding roller pair to a nipping state in which said second feeding roller pair nips the sheet or to a spaced state in which a nip of said second feeding roller pair is released, p1 wherein said controller carries out control so that said second feeding roller pair is switched to the nipping state or to the spaced state by said first switching cam, and wherein when said first feeding roller pair is moved in the widthwise direction of the sheet, said controller causes said first switching cam to switch said second feeding roller pair from the nipping state to the spaced state and then causes said first feeding roller pair to move in the widthwise direction of the sheet.

5. A sheet feeding device according to claim 4, wherein said detecting sensor is a contact image sensor and detects a sheet side end portion on one side, where the contact surface is disposed, with respect to a feeding center line of the sheet fed by said second feeding roller pair.

6. A sheet feeding device according to claim 5, further comprising a guiding member configured to guide the sheet fed by said second feeding roller pair, wherein said contact image sensor is fixed to said guiding member and detects the sheet side end portion at different positions between a case that a width of the fed sheet with respect to the widthwise direction is a first width and a case that the width of the fed sheet is a second width wider than the first width.

7. A sheet feeding device according to claim 4, further comprising a second switching cam configured to switch said first feeding roller pair to a nipping state in which said first feeding roller pair nips the sheet or to a spaced state in which a nip of said first feeding roller pair is released, wherein said controller controls said second switching cam, and wherein when the sheet is obliquely moved toward the contact surface by said obliquely feeding roller, said controller controls said second switching cam so as to switch a state of said first feeding roller pair from the nipping state to the spaced state and then causes said obliquely feeding roller to obliquely move the sheet.

8. A sheet feeding device according to claim 7, wherein the sheet is obliquely fed by said obliquely feeding roller in a state in which the sheet is rotated in contact with said obliquely feeding roller and when a state of the nip of said first feeding roller pair is switched from the nipping state to the spaced state by said second switching cam.

9. A sheet feeding device according to claim 1, wherein the predetermined position is positioned between the contact surface and said obliquely feeding roller with respect to the widthwise direction of the sheet and is positioned 4 mm spaced from the contact surface in a direction toward said obliquely feeding roller.

10. A sheet feeding device according to claim 7, further comprising:

a third feeding roller pair configured to feed the sheet fed by said obliquely feeding roller;

a motor configured to move said third feeding roller pair in the widthwise direction of the sheet in a state in which said third feeding roller pair nips the sheet; and a third switching cam configured to switch said obliquely feeding roller to a nipping state in which said obliquely feeding roller nips the sheet obliquely fed or to a spaced state in which said obliquely feeding roller is spaced from the sheet, wherein said controller controls said motor and said third switching cam, and wherein when said third feeding roller pair is moved in the widthwise direction of the sheet by said motor, said controller causes said third switching cam to move said obliquely feeding roller from the nipping state to the spaced state.

11. An image forming apparatus comprising:

feeding device according to claim 1; and an image former configured to form an image on the sheet fed by said sheet feeding device.

12. A sheet feeding device according to claim 1, further comprising a second feeding roller pair provided adjacent to and upstream of said first feeding roller pair with respect to the sheet feeding direction and movable in the widthwise direction of the sheet in a state in which said second feeding roller pair nips the sheet, said second feeding roller pair being configured to feed the sheet, wherein said controller causes said second feeding roller pair to move the sheet in the widthwise direction of the sheet in cooperation with said first feeding roller pair.

13. A sheet feeding device according to claim 1, wherein said reference member is movable in the widthwise direction of the sheet, wherein said controller controls movement of said reference member in the widthwise direction of the sheet, and wherein in a case that a length of the sheet fed is a first length, before the sheet is obliquely fed by said obliquely feeding roller, said controller causes said first feeding roller pair to move the sheet to the predetermined position in the widthwise direction of the sheet on the bases of the detection result of said detecting sensor, and wherein in a case that the length of the sheet fed is a second length longer than the first length, said controller causes said reference member to move the sheet to the predetermined position in the widthwise direction of the sheet on the bases of the detection result of said detecting sensor.

14. A sheet feeding device according to claim 13, wherein the second length is 762 mm with respect to the sheet feeding direction.

15. A sheet feeding device according to claim 1, wherein the width of said obliquely feeding roller and said contact surface overlaps entirely with the width of said detecting sensor along the conveyance direction.

16. A sheet feeding device according to claim 1, further comprising:

a second feeding roller pair provided upstream of said first feeding roller pair with respect to the sheet feeding direction and configured to feed the sheet;

a first switching cam configured to switch said second feeding roller pair to a nipping state in which said second feeding roller pair nips the sheet or to a spaced state in which a nip of said second feeding roller pair is released; and a second switching cam portion configured to switch said first feeding roller pair to a nipping state in which said first feeding roller pair nips the sheet or to a spaced state in which a nip of said first feeding roller pair is released, wherein the controller controls (i) the first switching cam to switch the second feeding roller pair from the nipping state to the spaced state during a time in which the first feeding roller pair nips the sheet, (ii) the first feeding roller pair to move in the widthwise direction during a time in which the second feeding roller pair is in the spaced state, and (iii) the second switching cam to switch the first feeding roller pair from the nipping state to the spaced state after the first feeding roller pair has moved in the widthwise direction and during a time in which the second feeding roller pair is in the spaced state.

* * * * *